US009078798B2

(12) United States Patent
Centenari

(10) Patent No.: US 9,078,798 B2
(45) **Date of Patent: *Jul. 14, 2015**

(54) CREMATION BOX

(71) Applicant: Peter Centenari, Ruxton, MD (US)

(72) Inventor: Peter Centenari, Ruxton, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/293,601

(22) Filed: Jun. 2, 2014

(65) Prior Publication Data

US 2014/0283347 A1 Sep. 25, 2014

Related U.S. Application Data

(63) Continuation of application No. 13/109,953, filed on May 17, 2011, now Pat. No. 8,739,375.

(60) Provisional application No. 61/345,470, filed on May 17, 2010.

(51) Int. Cl.

| | |
|---|---|
| ***A61G 17/007*** | (2006.01) |
| *A61G 17/00* | (2006.01) |
| *A61G 17/04* | (2006.01) |

(52) U.S. Cl.

CPC ..... *A61G 17/0073* (2013.01); *A61G 17/00* (2013.01); *A61G 2017/004* (2013.01); *A61G 2017/041* (2013.01); *A61G 2017/042* (2013.01)

(58) Field of Classification Search

CPC ... A61G 17/0073; A61G 17/00; A61G 17/04; A61G 2017/00; A61G 2017/004; A61G 2017/041; A61G 2017/042; B65D 5/12; B65D 5/247; B65D 5/302; B65D 5/4608; B65D 5/60

USPC ..... 27/4, 2, 19, 27; 229/117.6, 117.28, 229/125.01, 164.2, 188, 190, 195, 117.16; 220/6

See application file for complete search history.

(56) References Cited

U.S. PATENT DOCUMENTS

| | | | |
|---|---|---|---|
| 5,307,545 | A | 5/1994 | Stoltz |
| 5,586,679 | A | 12/1996 | Thomas |
| 5,661,879 | A | 9/1997 | Kelly |
| 5,775,061 | A | 7/1998 | Enneking et al. |
| 6,145,175 | A | 11/2000 | Enneking et al. |
| 6,202,270 | B1 | 3/2001 | Bowman et al. |
| 6,317,944 | B1 | 11/2001 | Beaulieu et al. |
| 6,557,221 | B2 | 5/2003 | Cox et al. |
| 6,571,440 | B1 | 6/2003 | Faulkner et al. |
| 6,694,579 | B2 | 2/2004 | Belanger et al. |
| 7,003,855 | B2 | 2/2006 | Lew |

(Continued)

*Primary Examiner* — William Miller

(74) *Attorney, Agent, or Firm* — Miles & Stockbridge P.C.; David R. Schaffer

(57) ABSTRACT

A corrugated fiberboard box assembly including a first portion including a bottom section having a pair of opposite long edges and a pair of opposite short edges with all edges being bounded by a plurality of creases, a pair of opposing side panels running along and connected to the pair of opposite long edges by two of the plurality of creases, and a pair of opposing end panels running along and connected to the pair of opposite short edges by another two of the plurality creases. The first portion being foldable to form a rectangular box with the bottom section on the bottom and the side panels and end panels both extending substantially perpendicularly upwardly away from the bottom to form side walls of the box. The box further includes a separate inner liner configured to fit within an inside of the side walls and a top configured to fit over the tops of the side walls.

13 Claims, 30 Drawing Sheets

(56) References Cited

U.S. PATENT DOCUMENTS

| | | | | |
|---|---|---|---|---|
| 7,322,079 | B2 | 1/2008 | Davis et al. | |
| 7,774,907 | B2 | 8/2010 | Rosato et al. | |
| 8,079,119 | B1 | 12/2011 | Ferko, III | |
| 8,104,151 | B2 | 1/2012 | Cox et al. | |
| 2014/0026378 | A1* | 1/2014 | Gessel et al. | 27/4 |

* cited by examiner

CREMATION BOX

CROSS-REFERENCE TO RELATED APPLICATIONS

This application is a division of application Ser. No. 13/109,953, filed May 17, 2011, now U.S. Pat. No. 8,739,375, which claims the priority benefit of U.S. Provisional Application 61/345,470, filed May 17, 2010, which is hereby incorporated by reference herein in its entirety.

FIELD OF THE INVENTION

The present invention relates to a corrugated fiberboard container and corrugated fiberboard container kits with multiple corrugated fiberboard containers for holding and moving a body in preparation for cremation and methods of manufacture and assembly for the corrugated fiberboard container and kit.

SUMMARY OF THE INVENTION

With a larger percentage of adults choosing cremation over burial for a variety of economic, environmental and personal preferences, a greater emphasis is placed on the methods and materials involved in the process. The present design offers both an answer to finding the most desirable method and material to the cremation process.

Corrugated fiberboard was selected as the material to be used for the cremation box. Corrugated fiberboard others a distinct advantage over other materials. With its inherent strength, incendiary nature and low cost, corrugated fiberboard is the logical choice to accomplish the environmental and economic goals of the deceased.

The present design was created to improve the method and needs of the crematory technicians. The crematory technicians must have the cremation box be flexible enough to load the deceased, strong enough to carry the deceased, and flammable enough to leave little waste behind after the cremation. The corrugated fiberboard design present below achieves all of these prerequisites.

According to the present invention, the corrugated cremation box offers a unique design and ability to be fabricated from single, double or triple thickness corrugated fiberboard, depending on the preference of the technician. The four sides and bottom of the cremation box are one piece. During shipment two boxes are shipped together, each utilizes a piece of the outside shipment container for the top of their respective box.

There is no need for dowels, pins or outside materials. The present design offers the technician the ability to interlock each panel with one another. The body may be placed on top of the box prior to assembly or placed into the box from the bottom panel, which is subsequently connected to the side panels. The technician then takes either the top or bottom of the aforementioned shipping package and places this piece on top of the box. The design specifications allow for this to fit tight enough to avoid the need for straps, locks, hinges or tape.

BRIEF DESCRIPTION OF THE DRAWINGS

The utility, objects, features, and advantages of the present invention will be readily appreciated and understood from consideration of the following detailed description of the embodiments of this invention, when taken with the accompanying drawings, in which.

DETAILED DESCRIPTION

As times change, so do traditions. The age-old practice of a casket burial has seen a decline as cremation becomes a viable option for many in today's economically-frugal, environmentally-conservative and philosophically-diverse society. The demand for more efficient and effective cremation materials and procedures has never been higher.

In response to this ideological shift and its corresponding needs, a cremation box, in accordance with embodiments of the present invention, provides an ideal structure to facilitate the cremation process for both the deceased and the practitioner.

A cremation box is produced by cutting and creasing corrugated fiberboard to form the four (4) components of the cremation box, specifically, a main unit, a top, a bottom, and a liner as shown and described in FIGS. 1 to 40, in accordance with an embodiment of the present invention. The construction of the cremation box of the present invention can be further understood and the actual assembly of the cremation box can occur in accordance with the detailed description and assembly instructions provided below.

Figure 1:
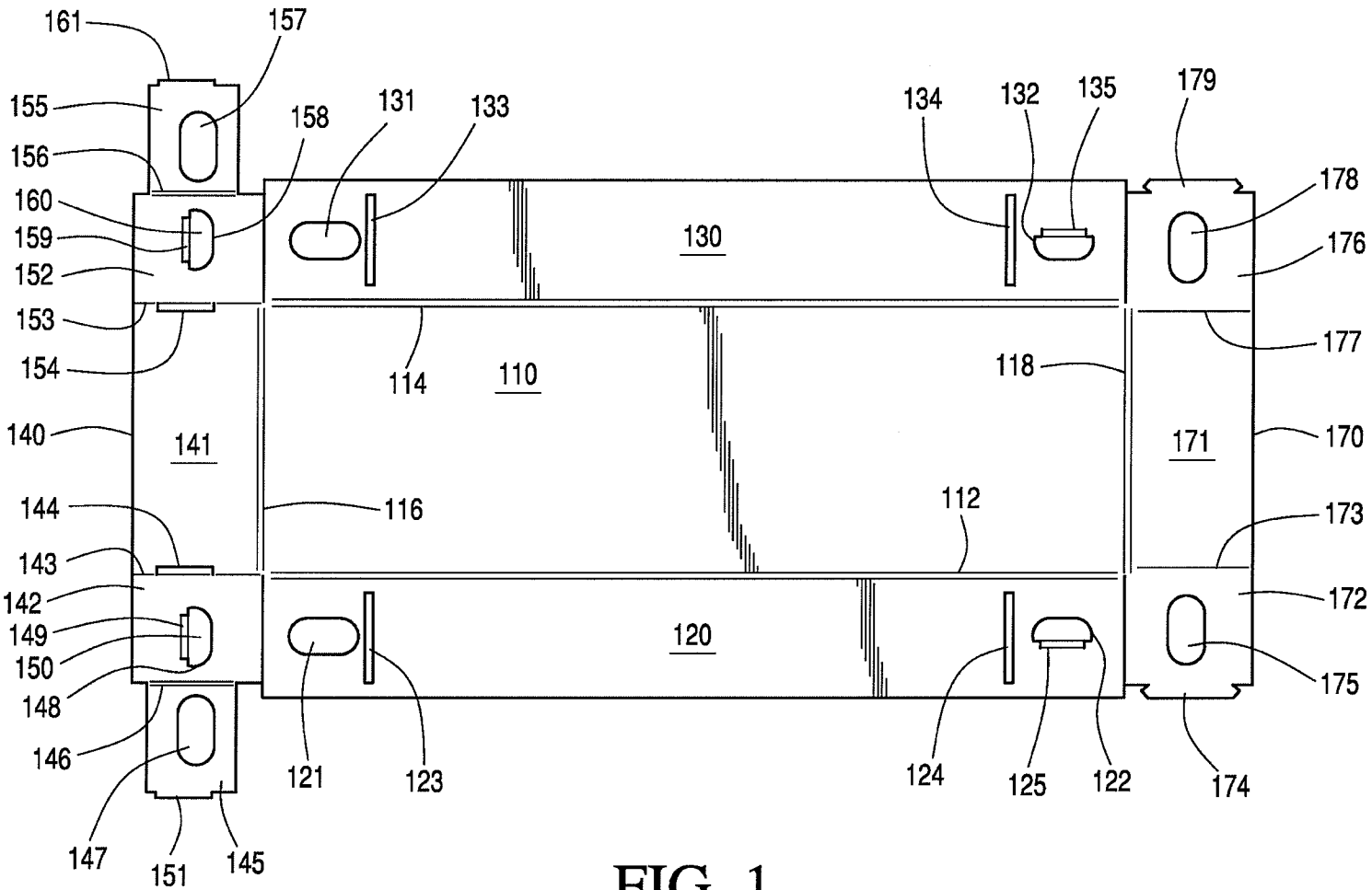
FIG. 1 is a plan view of a main unit portion of a cremation box showing specific design features and measurements of the main unit, in accordance with an embodiment of the present invention.

FIG. 1 is a plan view of a main unit portion of a cremation box showing specific design features and measurements of the main unit, in accordance with an embodiment of the present invention. In FIG. 1, a cremation box 100 includes a bottom portion 110, a left side panel 120 connected to a left edge of the bottom portion 110 by a left side crease portion 112 extending the length of the bottom portion 110 and the left side panel 120, a right side panel 130 connected to a right edge of the bottom portion 110 by a right side crease portion 114 extending the length of the bottom portion 110 and the right side panel 130, a top end panel 140 connected to a top edge of the bottom portion 110 by a top end crease portion 116 extending the width of the bottom portion 110 and the top end panel 140, and a bottom end panel 150 connected to a bottom edge of the bottom portion 110 by a bottom end crease portion 118 extending the width of the bottom portion 110 and the bottom end panel 150. In FIG. 1, a top left hand hole 121 is formed in the left side panel 120 adjacent the top end of the left side panel 120 and a bottom left hand hole 122 is formed in the left side panel 120 adjacent the bottom end of the left side panel 120. However, unlike the top left hand hole 121, which is completely cut out and open, the bottom left hand hole 122 is partially cut out around about three-quarters of the bottom left hand hole 122 closest to the left side crease portion 112, so the portion of the portion of the left side panel 120 inside the bottom left hand hole 122 remains connected to the left side panel 120 by a crease 125 on the side of the bottom left hand hole 122 closest to the outer edge of the left side panel 120. Similarly, a top left slot 123 is formed in the left side panel 120 adjacent the top left hand hole 121 in the left side panel 120 and a bottom left slot 124 is formed in the left side panel 120 adjacent the bottom left hand hole 122 in the left side panel 120.

In FIG. 1, a top right hand hole 131 is formed in the right side panel 130 adjacent the top end of the right side panel 130 and a bottom right hand hole 132 is formed in the right side panel 130 adjacent the bottom end of the right side panel 130. However, unlike the top right hand hole 131, which is completely cut out and open, the bottom right hand hole 132 is partially cut out around about three-quarters of the bottom right hand hole 132 closest to the right side crease portion 114, so the portion of the portion of the right side panel 130 inside the bottom right hand hole 132 remains connected to the right side panel 130 by a crease 135 on the side of the bottom right hand hole 132 closest to the outer edge of the right side panel 130. Similarly, a top right slot 133 is formed in the right side panel 130 adjacent the top right hand hole 131 in the right side panel 130 and a bottom right slot 134 is formed in the right side panel 130 adjacent the bottom right hand hole 132 in the right side panel 130.

In FIG. 1, the top end panel 140 includes a top end center section 141 connected to a top left inside side flap 142 by a crease 143 on one side, the top left inside side flap 142 is in turn connected to a top left outside flap 145 by another crease 146 on another side. A top left slot 144 is formed in a left edge of the top end center section 141 with one side along crease 143. A top left outside flap 145 has a hand hole 147 formed therein and a tab 151 extending outwardly away from and along a portion of an outer left edge of the top left outside flap 145. A left inside side flap hand hole 148 is formed in about the center of the top left inside side flap 142. However, unlike the top left outside flap hand hole 147, which is completely cut out and open, the left inside side flap hand hole 148 is partially cut out around about three-quarters of the left inside side flap hand hole 148 closest to an inside edge of the top left inside side flap 142, so a portion 150 of the top left inside side flap 142 remains connected to the top left inside side flap 142 by a crease 149 on the side of the top left inside side flap 142 closest to the outer edge of the top left inside side flap 142.

In FIG. 1, a right side of the top end center section 141 is connected to a top right inside side flap 152 by a crease 153 on one side, the top right inside side flap 152 is in turn connected to a top right outside flap 155 by another crease 156 on another side. A top right slot 154 is formed in a right edge of the top end center section 141 with one side along crease 153. A top right outside flap 155 has a hand hole 157 formed therein and a tab 161 extending outwardly away from and along a portion of an outer left edge of the top right outside flap 155. A right inside side flap hand hole 158 is formed in about the center of the top right inside side flap 152. However, unlike the top right outside flap hand hole 157, which is completely cut out and open, the right inside side flap hand hole 158 is partially cut out around about three-quarters of the right inside side flap hand hole 158 closest to an inside edge of the top right inside side flap 152, so a portion 160 of the top right inside side flap 152 remains connected to the top right inside side flap 152 by a crease 159 on the side of the top right inside side flap 152 closest to the outer edge of the top right inside side flap 152.

In FIG. 1, the bottom end panel 170 includes a bottom end center section 171 is connected to a bottom left side flap 172 by a crease 173 on a left side, the bottom left side flap 172 is in turn connected to a tab 174 extending outwardly away from and along a portion of an outer left edge of the bottom left flap 172. A bottom left side flap hand hole 175 is formed in about the center of the bottom left side flap 172. The bottom end center section 171 is also connected to a bottom right side flap 176 by a crease 177 on a right side, the bottom right side flap 176 is in turn connected to a tab 179 extending outwardly away from and along a portion of an outer right edge of the bottom right flap 176. A bottom right side flap hand hole 178 is formed in about the center of the bottom right side flap 176.

In FIG. 1, the length of the unassembled cremation box 100 is 97⅞ inches and the width is 63 inches. When the cremation box is assembled, the inner dimensions are 75⅜ inches long by 23 Yz inches wide by 10⅝ inches high. The corrugated fiberboard used for the cremation box 100 can include 1-200 BC Kraft, 1-275 BC Kraft and 1-350 BC Kraft weight and, generally, the cremation box 100 portion is made using 1-350 BC Kraft weight corrugated fiberboard.

Figure 2:
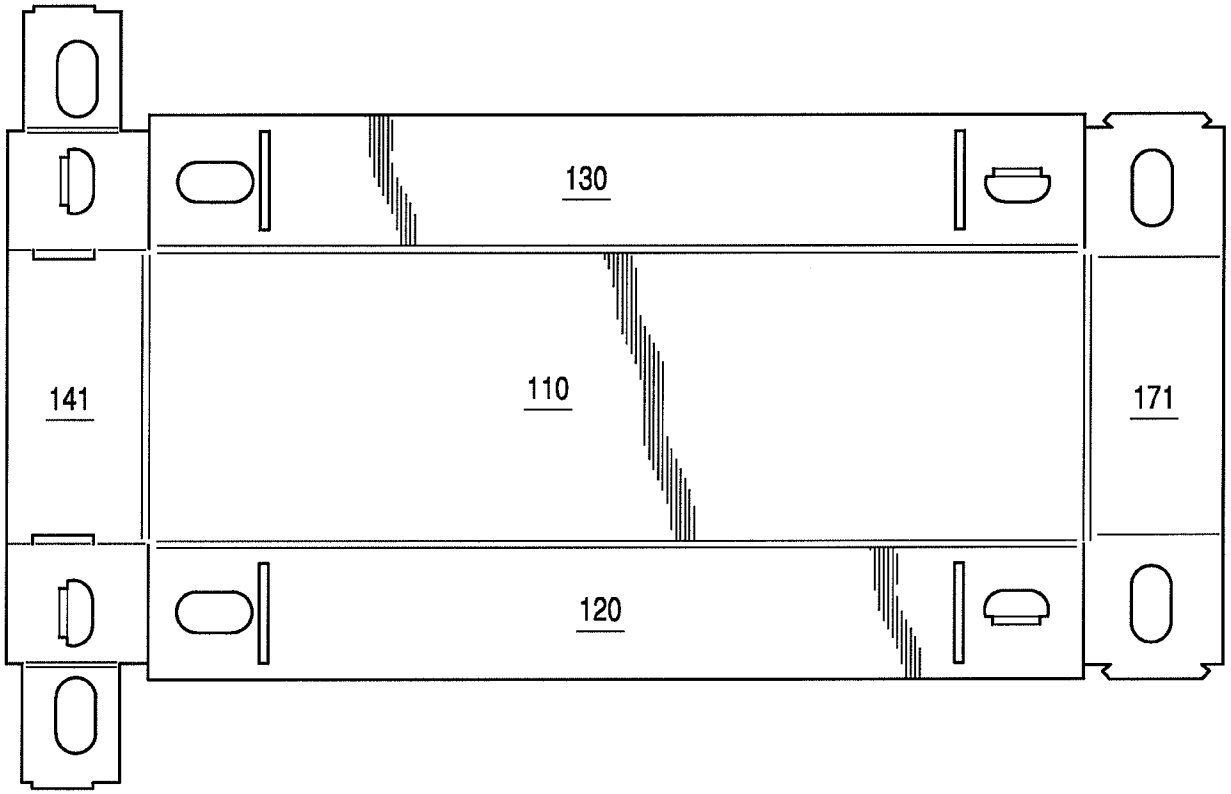
FIG. 2 is a plan view of the main unit portion of the cremation box of FIG. 1, in accordance with an embodiment of the present invention.

FIG. 2 is a plan view of the main unit portion of the cremation box 100 of FIG. 1 highlighting the main sections of the cremation box 100, in accordance with an embodiment of the present invention.

Figure 3:
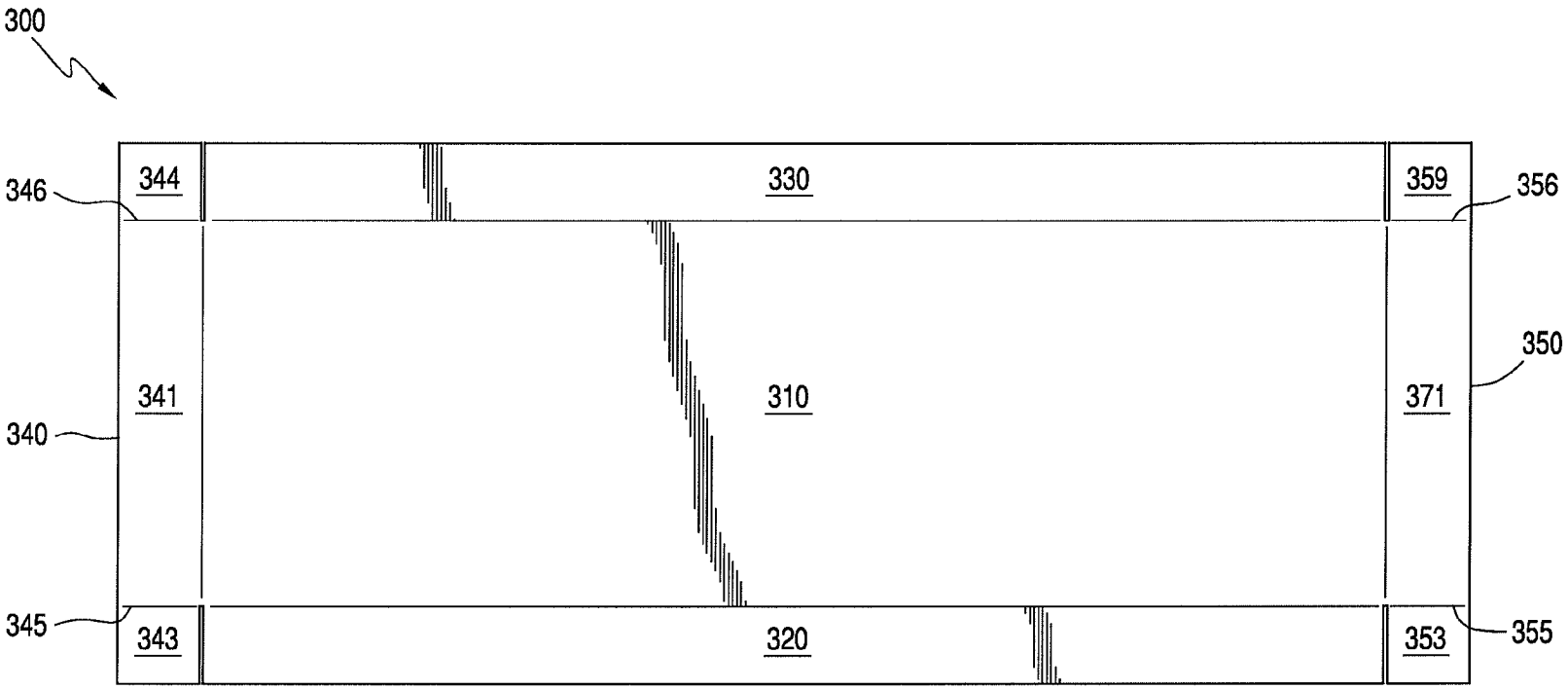
FIG. 3 is a plan view of a top of a container box showing specific design features and measurements of the top, in accordance with an embodiment of the present invention.

FIG. 3 is a plan view of a top of a container box showing specific design features and measurements of the top, in accordance with an embodiment of the present invention. In FIG. 3, a top 300 includes a top body portion 310 connected to a left side panel 320 by a left side crease portion 322 extending the length of a left side of the top body portion 310 and the left side panel 320, a right side panel 330 connected to a right edge of the top body portion 310 by a right side crease portion 332 extending the length of the top body portion 310 and the right side panel 330, a top end top panel 340 connected to a top edge of the top body portion 310 by a top end crease portion 342 extending the width of the top portion 310 and the top end top panel 340, and a top end bottom panel 350 connected to a bottom edge of the bottom portion 310 by a bottom end crease portion 352 extending the width of the bottom portion 310 and the bottom end panel 350. The top end top panel 340 includes a top center section 341, which is connected to the top body portion 310 by the top end crease portion 342. The top center section 341 is connected on a left side to a left side flap 343 by a crease 345 and is connected on a right side to a right side flap 344 by a crease 346. The bottom end top panel 350 includes a center section 351, which is connected to the top body portion 310 by the bottom end crease portion 352. The center section 351 is connected on a left side to a left side flap 353 by a crease 355 and is connected on a right side to a right side flap 354 by a crease 356. When assembled, the top 300 fits over the top of the cremation box 100 of FIG. 1. The corrugated fiberboard used for the top 300 can include 1-200 BC Kraft, 1-275 BC Kraft and 1-350 BC Kraft weight and, generally, the top 300 is made using 1-200 BC Kraft weight corrugated fiberboard.

In FIG. 3, in accordance with one or more embodiments of the present invention, the outer dimensions of the unassembled top can include a length of 87 13/32 and a width of 35 9/32, the dimensions of the top body portion 310 can include a length of 76% and a width of 24% inches, the side panels 320, 330 can include a length of 76% and a width of 5 inches, and the end panels can include a length of 35 9/32 and a width of 5 inches, where the center of the end panels is connected to the respective top and bottom ends of the top body portion 310.

Figure 4:
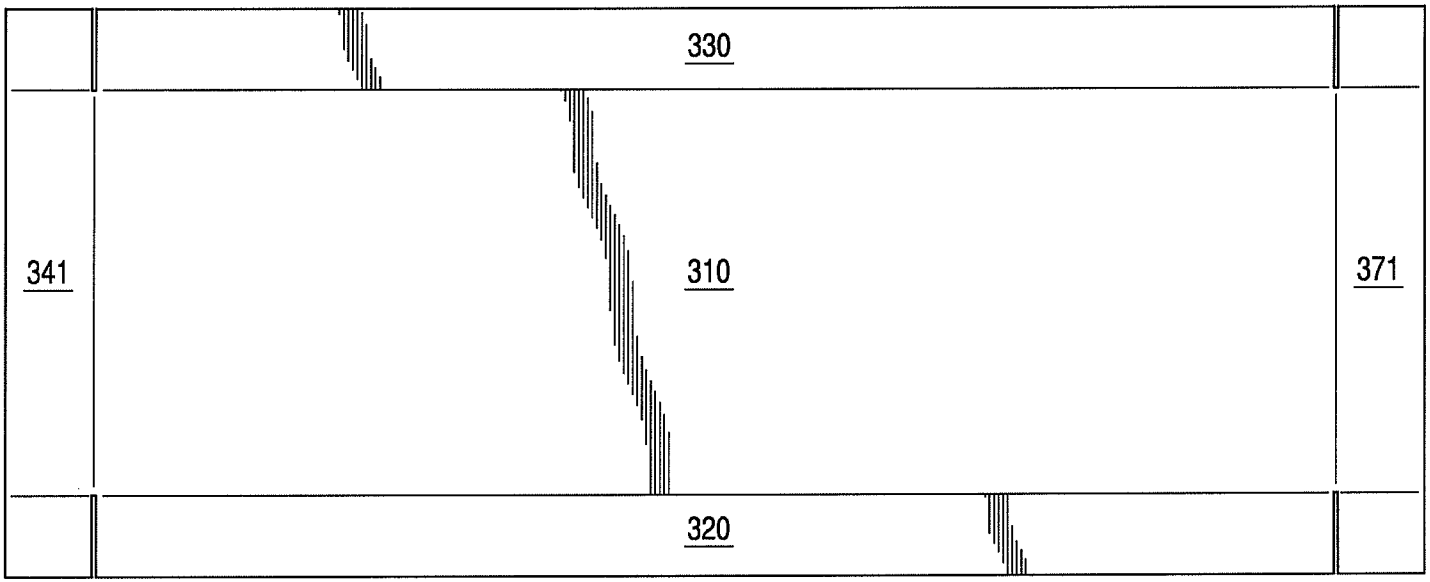
FIG. 4 is a plan view of the top of the container box of FIG. 3, in accordance with an embodiment of the present invention.

FIG. 4 is a plan view of the top of the container box of FIG. 3 highlighting the main sections of the top body portion 310, in accordance with an embodiment of the present invention.

Figure 5:
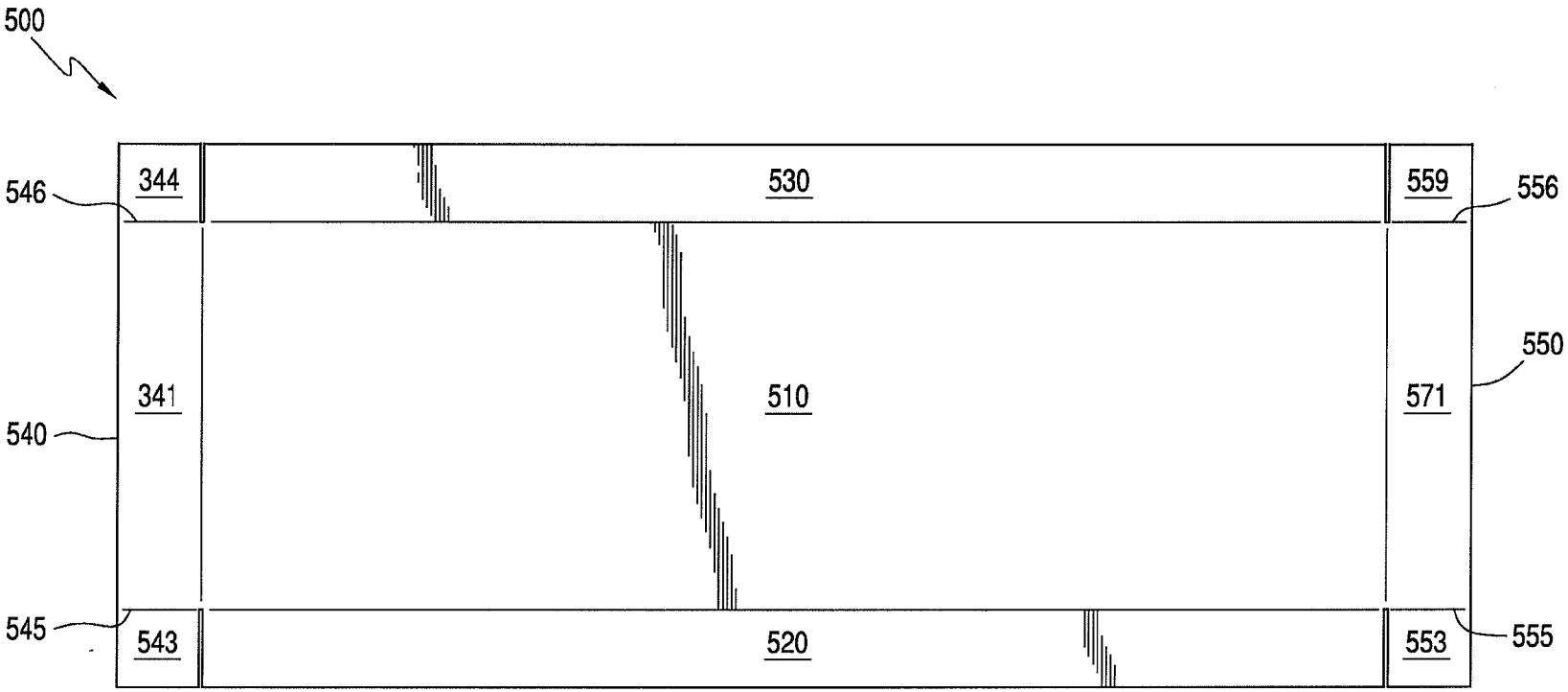
FIG. 5 is a plan view of a bottom of a container box showing specific design features and measurements of the bottom, in accordance with an embodiment of the present invention.

FIG. 5 is a plan view of a bottom of a container box showing specific design features and measurements of the bottom, in accordance with an embodiment of the present invention. In FIG. 5, a bottom portion 500 includes a bottom body portion 510 connected to a left side panel 520 by a left side crease portion 522 extending the length of a left side of the bottom body portion 510 and the left side panel 520, a right side panel 530 connected to a right edge of the bottom body portion 510 by a right side crease portion 532 extending the length of the bottom body portion 510 and the right side panel 530, a bottom end top panel 540 connected to a top edge of the bottom body portion 510 by a top end crease portion 542 extending the width of the bottom body portion 510 and the top end top panel 540, and a top end bottom panel 550 connected to a bottom edge of the bottom body portion 510 by a bottom end crease portion 552 extending the width of the bottom portion 510 and the bottom end panel 550. The top end top panel 540 includes a top center section 541, which is connected to the bottom body portion 510 by the top end crease portion 542. The top center section 541 is connected on a left side to a left side flap 543 by a crease 545 and is connected on a right side to a right side flap 544 by a crease 546. The bottom end top panel 550 includes a center section 551, which is connected to the bottom body portion 510 by the bottom end crease portion 552. The center section 551 is connected on a left side to a left side flap 553 by a crease 555 and is connected on a right side to a right side flap 554 by a crease 556. When assembled, like the top portion 510 of FIG. 3, the bottom body portion 510 fits over the top of the cremation box 100 of FIG. 1. Although in this embodiment the dimensions of the bottom body portion 510 are smaller than the top body portion 310 of FIG. 3, the opposite may also be true.

In FIG. 5, in accordance with one or more embodiments of the present invention, the outer dimensions of the unassembled bottom 300 can include a length of $86\frac{25}{32}$ and a width of $34\frac{25}{32}$ inches, the dimensions of the bottom body portion 510 can include a length of 76 V4 and a width of 24 V4 inches, the side panels 520, 530 can include a length of 76 V4 and a width of 5 inches, and the end panels can include a length of $34\frac{25}{32}$ and a width of 5 inches, where the center of the end panels is connected to the respective top and bottom ends of the bottom body portion 510. While the dimensions of the bottom 500 in the embodiment described above is slightly larger than the dimensions of the top 300, in other embodiments the bottom and top dimensions may be reversed. The corrugated fiberboard used for the bottom 500 can include 1-200 BC Kraft, 1-275 BC Kraft and 1-350 BC Kraft weight and, generally, the bottom 500 is made using 1-200 BC Kraft weight corrugated fiberboard.

Figure 6:
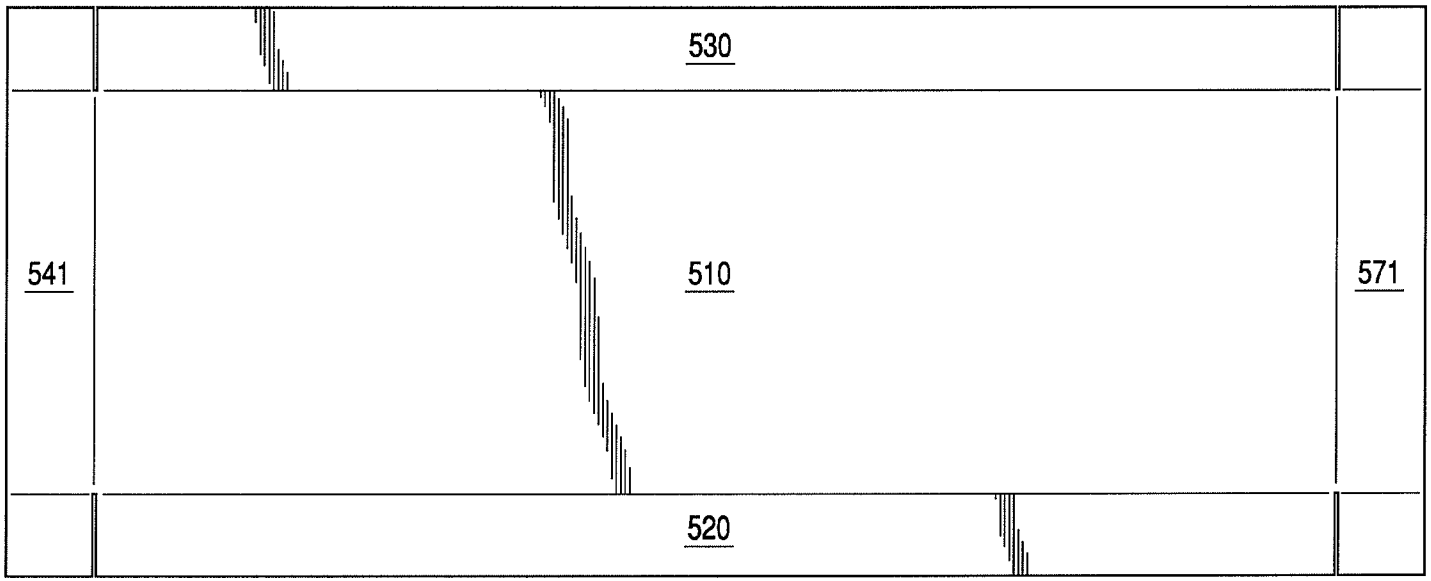
FIG. 6 is a plan view of the bottom of the container box of FIG. 5, in accordance with an embodiment of the present invention.

FIG. 6 is a plan view of the bottom of the container box of FIG. 5 highlighting the main sections of the top body portion 510, in accordance with an embodiment of the present invention.

Figure 7:
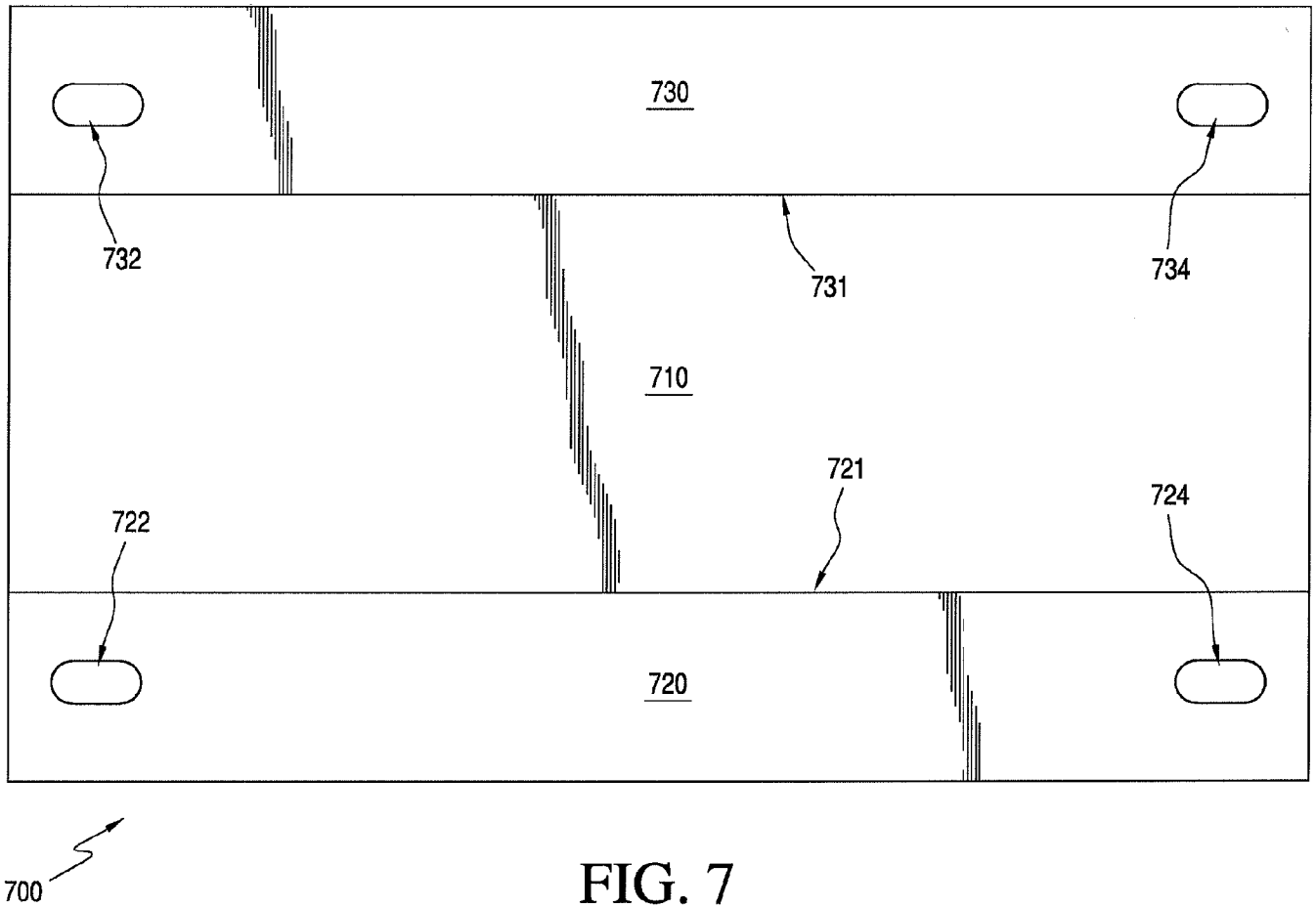
FIG. 7 is a plan view of a liner for a cremation box, in accordance with an embodiment of the present invention.

FIG. 7 is a plan view of a liner for a cremation box, in accordance with an embodiment of the present invention. In FIG. 7, a liner 700 includes a liner body portion 710 connected to a left side liner panel 720 by a left crease 721 extending the length of the liner body portion 710 and the left side liner panel 720 and the liner body portion 710 is also connected to a right side liner panel 730 by a right crease 731 extending the length of the liner body portion 710 and the right side liner panel 730. The left side liner panel 720 further includes a top left hand hole 722 formed in the left side liner panel 720 adjacent a top end of the left side liner panel 720 and a bottom left hand hole 724 formed in the left side liner panel 720 adjacent the bottom end of the left side liner panel 720. The right side liner panel 730 further includes a top right hand hole 732 formed in the right side liner panel 730 adjacent a top end of the right side liner panel 730 and a bottom right hand hole 734 formed in the right side liner panel 730 adjacent the bottom end of the right side liner panel 730. The corrugated fiberboard used for the liner 700 can include 1-200 BC Kraft, 1-275 BC Kraft and 1-350 BC Kraft weight and, generally, the liner 700 is made using either 1-275 BC Kraft weight or 1-350 BC Kraft corrugated fiberboard.

Figure 8:
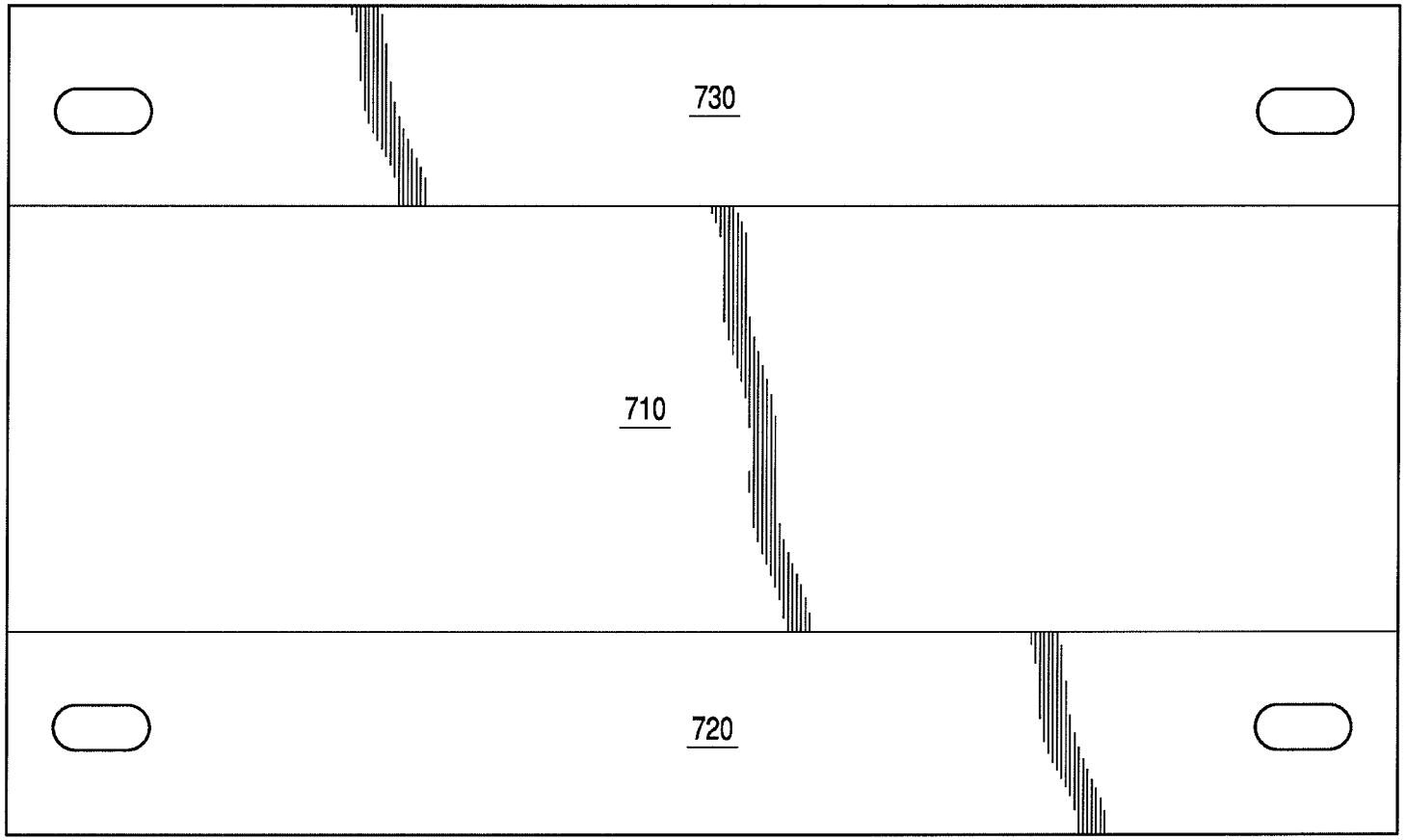
FIG. 8 is a plan view of the liner of the cremation box of FIG. 5 showing specific design features and measurements of the liner, in accordance with an embodiment of the present invention.

FIG. 8 is a plan view of the liner of the cremation box of FIG. 5 showing specific design features and measurements of the liner, in accordance with an embodiment of the present invention. In FIG. 8, in accordance with one or more embodiments of the invention, a length of the liner body portion 710 and each of the side liner panels 720, 730 is $74\frac{13}{16}$ inches and a width of the liner body portion 710 is 22% inches. The width of the side liner panels 720, 730 is $10\frac{15}{16}$ inches. Notwithstanding the dimensions given above, the dimensions of the liner will be adjusted to fit closely within the inner dimensions of the cremation box 100.

Assembly Instructions

The following is a step-by-step guide for constructing the cremation box.

Figure 9:
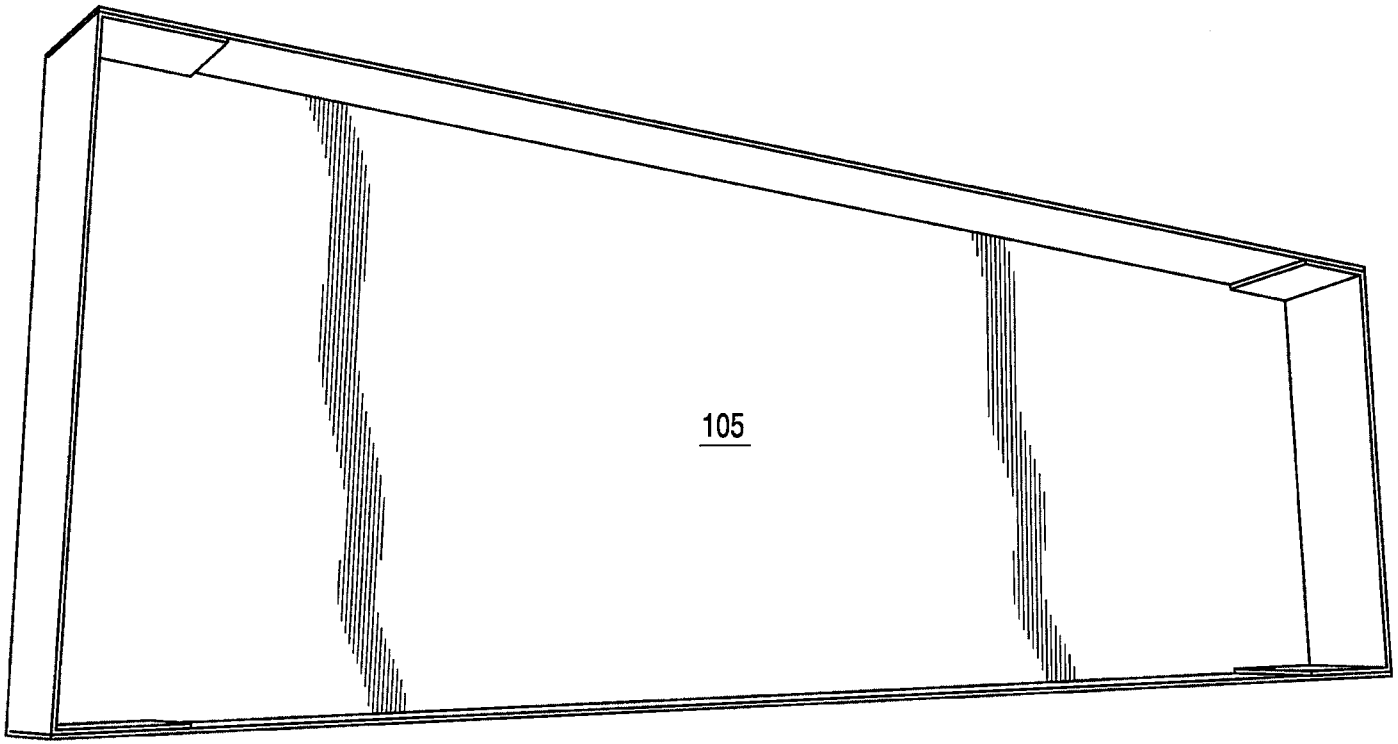
FIG. 9 is a bottom perspective view of one half of a container in which a cremation box is shipped, in accordance with an embodiment of the present invention.

Step 1:

FIG. 9 is a bottom perspective view of one half of a container in which a cremation box is shipped, in accordance with an embodiment of the present invention. In FIG. 9, a top 105 for the cremation box 100 also acts as half of a shipping container for the cremation box 100. In the shipment configuration, the other half of the shipping container is a bottom (see FIGS. 5 and 6) that can either fit within or over the top 105 and that is configured substantially identically to the top 105. Since they are used as part of the cremation box 100, the top 105 and bottom of the shipping container should not be damaged during opening and not discarded. This reduction of waste is environmentally friendly and fiscally responsible.

Figure 10:
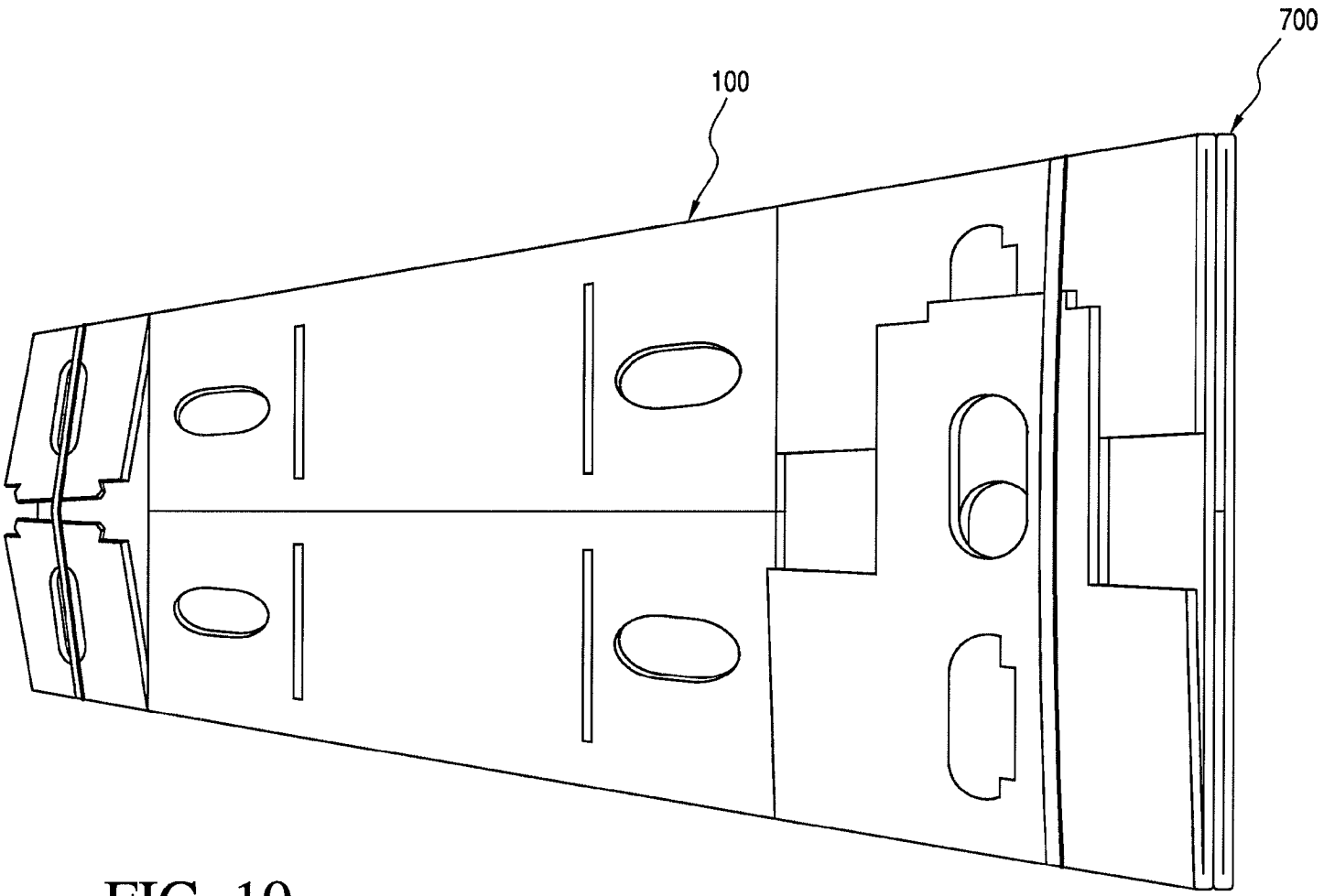
FIG. 10 is a top perspective view of a bound first portion and a liner of a cremation box, in accordance with an embodiment of the present invention.

Step 2:

FIG. 10 is a top perspective view of a bound first portion and a liner of a cremation box, in accordance with an embodiment of the present invention. FIG. 10 shows a cremation box 100 bound to a liner 700.

Figure 11:
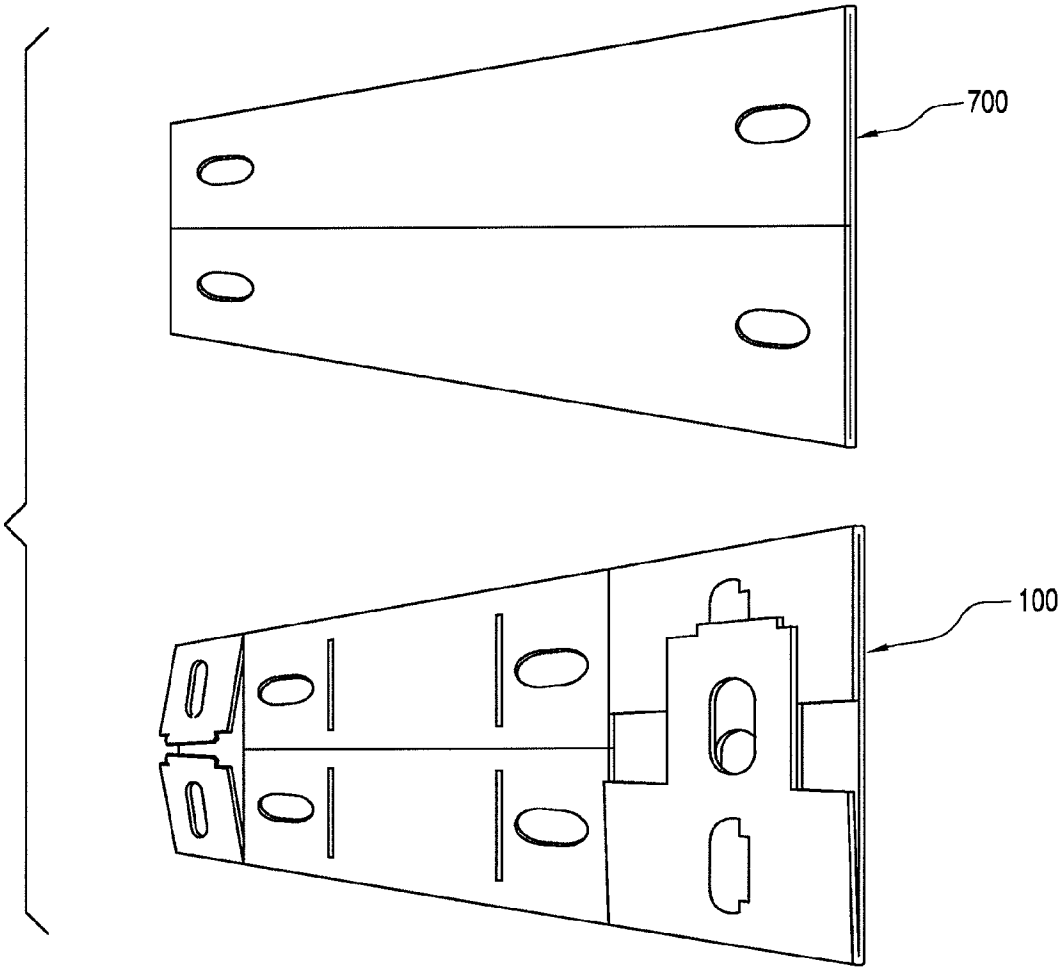
FIG. 11 is a side perspective view of the unbound first portion and liner of the cremation box of FIG. 10, in accordance with an embodiment of the present invention.

FIG. 11 is a side perspective view of the unbound first portion and liner of the cremation box of FIG. 10 after removal of the binding strap and separation of the cremation box 100 and the liner 700, in accordance with an embodiment of the present invention.

Figure 12:
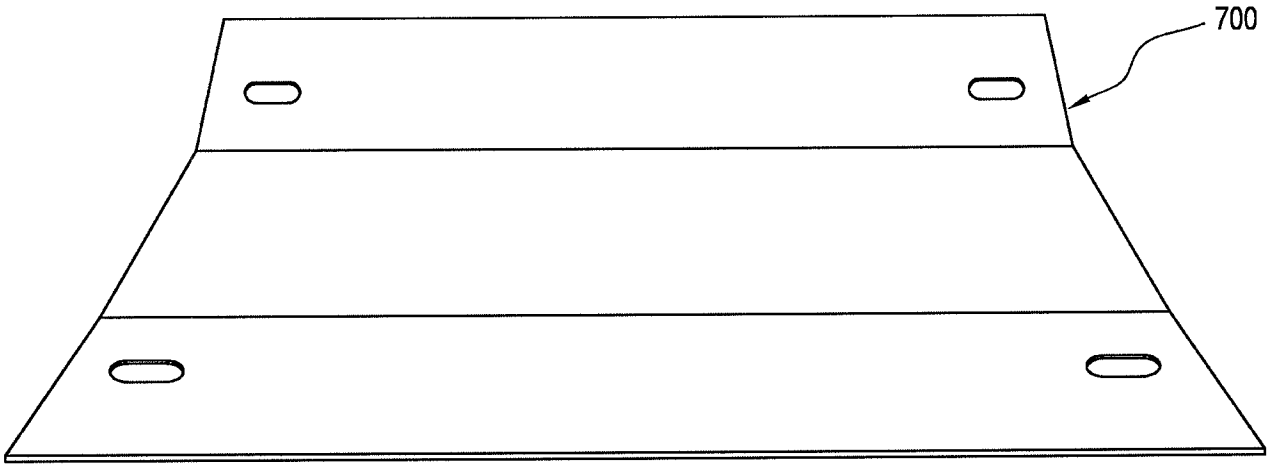
FIG. 12 is a side perspective view of an open liner of the cremation box of FIGS. 10 and 11, in accordance with an embodiment of the present invention.

FIG. 12 is a side perspective view of an open liner of the cremation box of FIGS. 10 and 11, in accordance with an embodiment of the present invention. The liner 700 is generally used for larger-sized, heavier individuals needing extra support. If the deceased does indeed require the extra support, the can be used with the cremation box 100. No additional materials, dowels, hinges, nails of any kind are needed to construct the cremation box.

Figure 13:
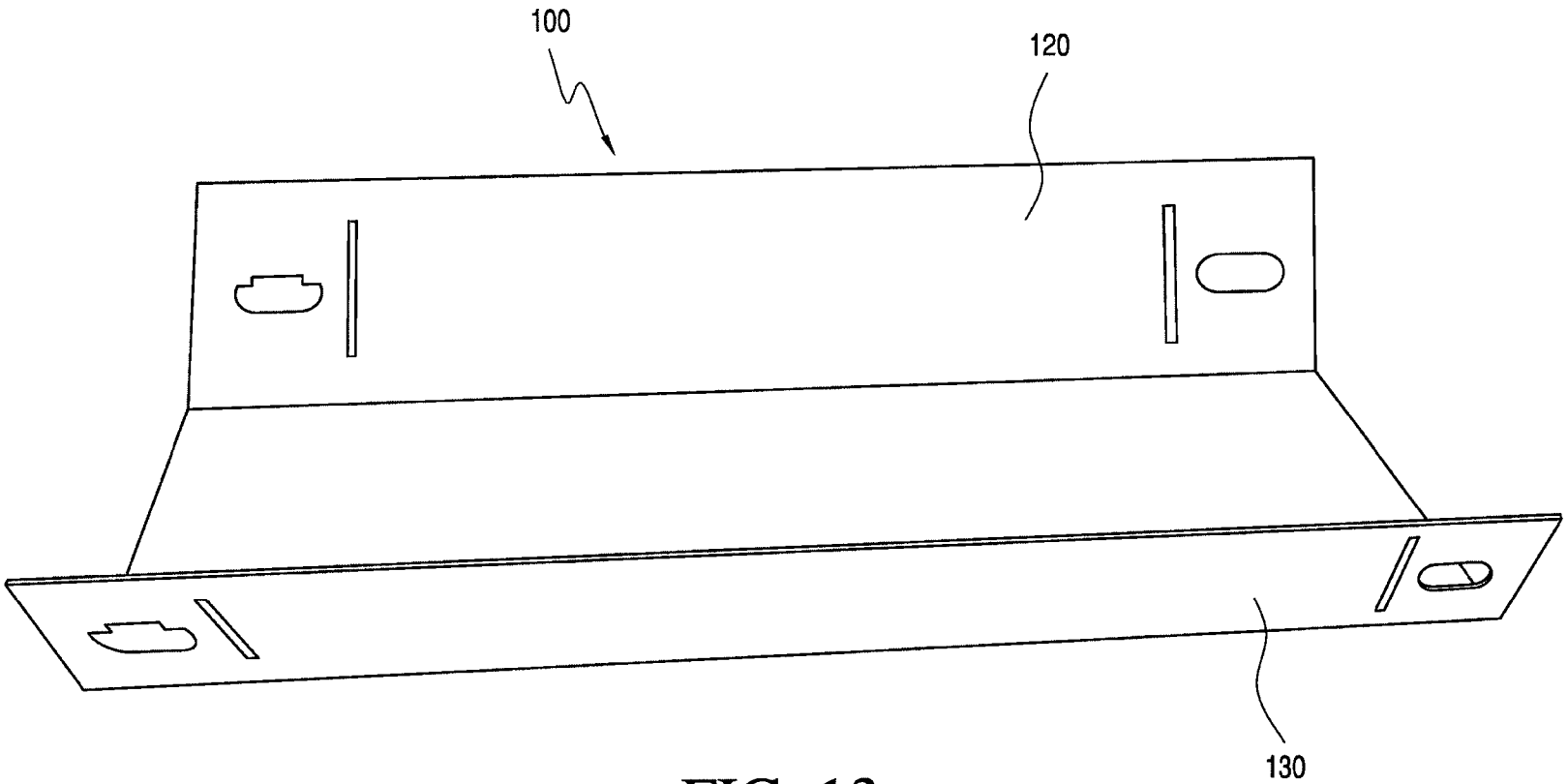
FIG. 13 is a side perspective view of a partially open first portion of the cremation box of FIGS. 10 and 11, in accordance with an embodiment of the present invention.

Step 3:

FIG. 13 is a side perspective view of a partially open first portion of the cremation box of FIGS. 10 and 11, in accordance with an embodiment of the present invention. In FIG. 13, the cremation box 100 is shown after the side panels 120 and 130 are opened away from the cremation box body portion 110.

Figure 14:
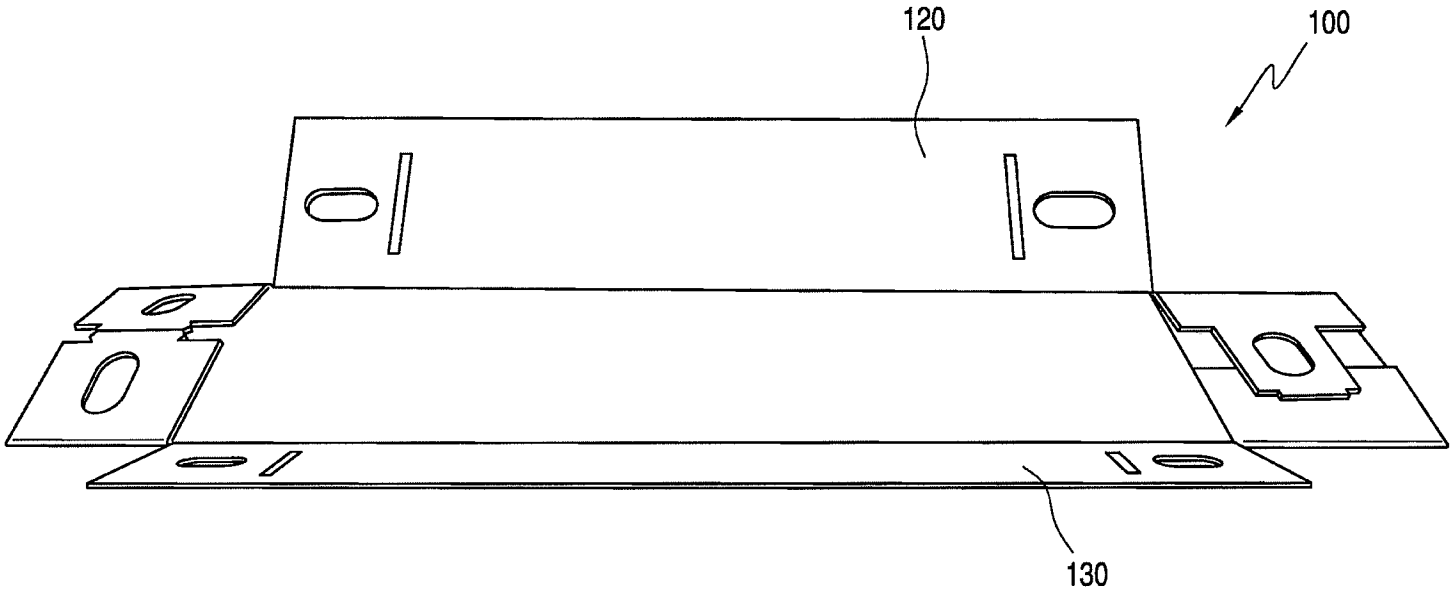
FIG. 14 is a side perspective view of the first portion of the cremation box of FIG. 13 in a more open position, in accordance with an embodiment of the present invention.

FIG. 14 is a side perspective view of the first portion of the cremation box of FIG. 13 in a more open position, in accordance with an embodiment of the present invention. In FIG. 14, the cremation box 100 is shown after the side panels 120 and 130 are fully opened away from the cremation box body portion 110.

Figure 15:
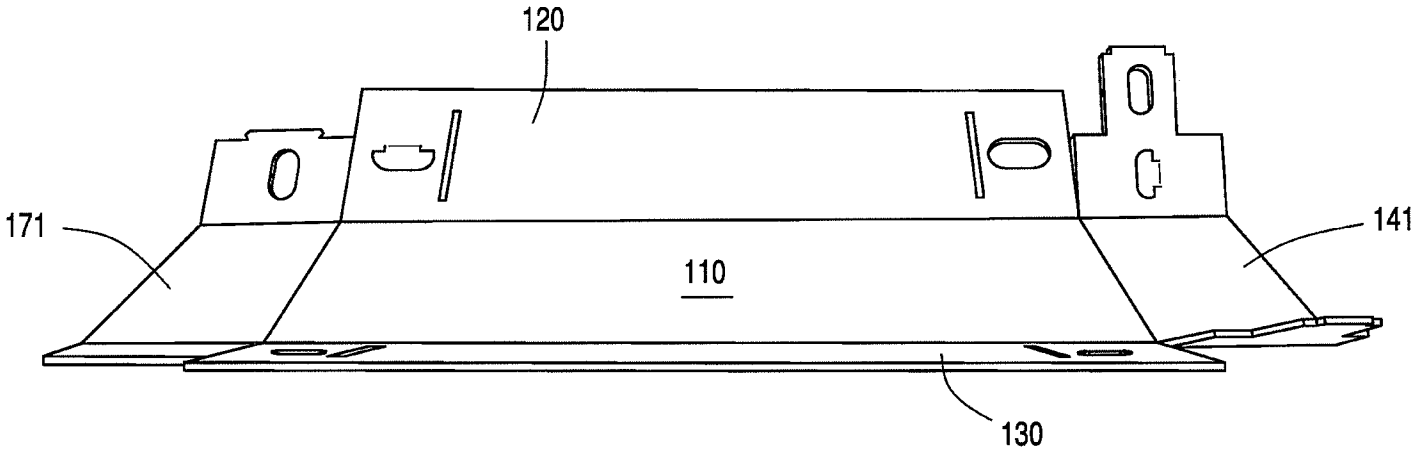
FIG. 15 is a side perspective view of the first portion of the cremation box of FIG. 14 in a fully open position, in accordance with an embodiment of the present invention.

FIG. 15 is a side perspective view of the first portion of the cremation box of FIG. 14 in a fully open position, in accordance with an embodiment of the present invention. In FIG. 13, the cremation box 100 is shown after the end panels 141 and 171 are opened away from the cremation box body portion 110.

At this point, the cremation box 100 is open and ready for assembly.

Figure 16:
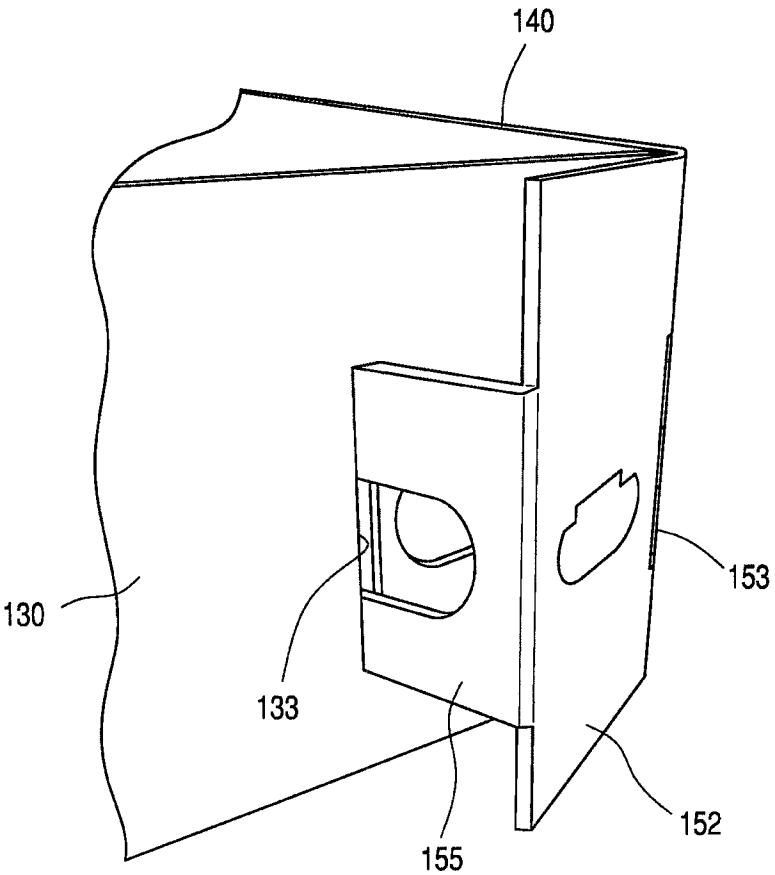
FIG. 16 is a side perspective view of a top right end of the first portion of the cremation box of FIG. 15 in a partially assembled position, in accordance with an embodiment of the present invention.

Step 4:

FIG. 16 is a side perspective view of a top right end of the first portion of the cremation box of FIG. 15 in a partially assembled position, in accordance with an embodiment of the present invention.

In FIG. 16, one side panel, for example, the right side panel 130 is folded upwardly to be positioned in a substantially perpendicular relationship to the cremation box body portion 110. The top end panel 140 is next raised to be positioned in a substantially perpendicular relationship to the cremation box body portion 110 and the right side panel 130 and the top right inside side flap 152 is folded down against the outside of the right side panel 130 along crease 153 and the top right outside side flap 155 is folded toward and pushed through top right slot 133.

Figure 17:
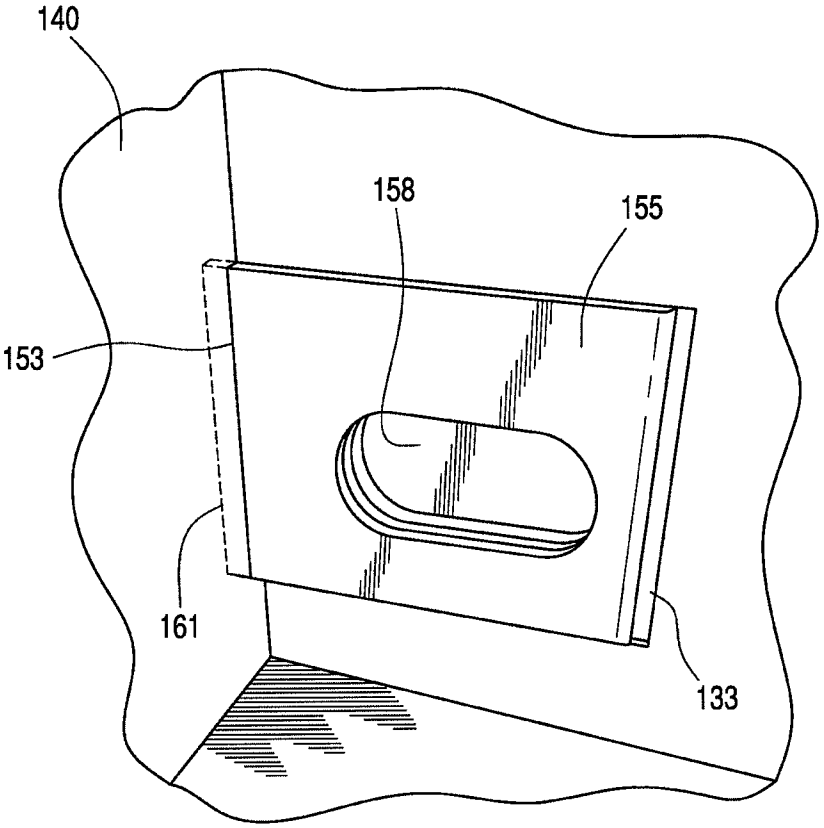
FIG. 17 is an inside view of the top right end of the first portion of the cremation box of FIG. 15 in a fully assembled position, in accordance with an embodiment of the present invention.

Step 5:

FIG. 17 is an inside view of the top right end of the first portion of the cremation box of FIG. 15 in a fully assembled position, in accordance with an embodiment of the present invention. In FIG. 17, the top right outside side flap 155 is fully pushed through top right slot 133 and folded back toward the top end panel 140 and tab 161 is inserted into slot

153 in top end panel 140 to lock the assembly into place and should now stand on their own and be joined into place without requiring any outside force or material. At this stage of the assembly, the right inside side flap hand hole 158 should not be pushed through the other hand holes, if the liner 700 will be used with the cremation box 100.

Figure 18:
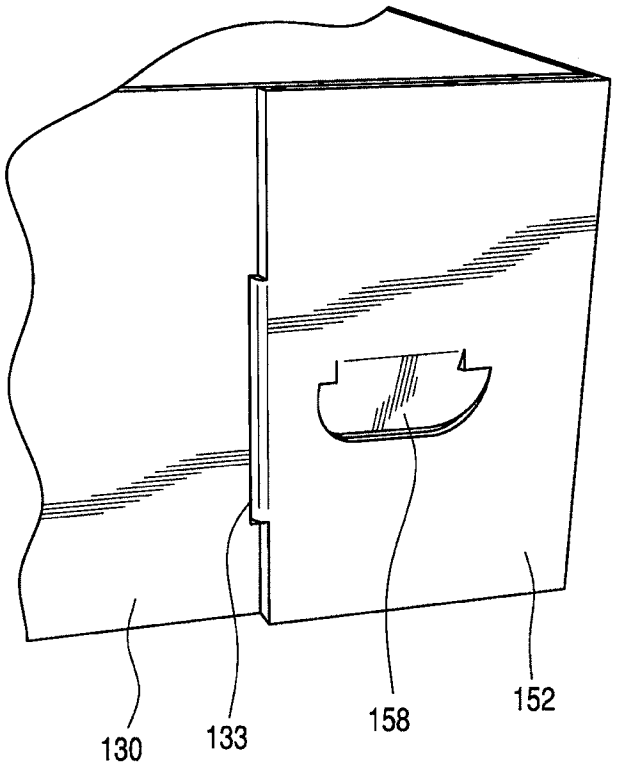
FIG. 18 is an outside view of the top right end of the first portion of the cremation box of FIG. 15 in a fully assembled position, in accordance with an embodiment of the present invention.

FIG. 18 is an outside view of the top right end of the first portion of the cremation box of FIG. 15 in a fully assembled position, in accordance with an embodiment of the present invention.

Figure 19:
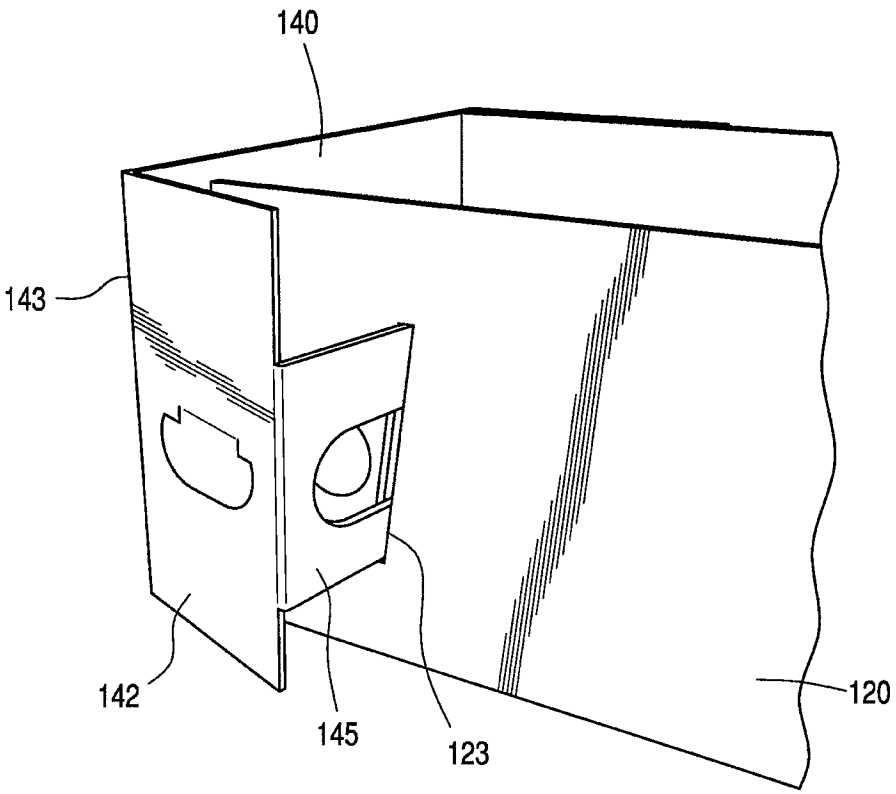
FIG. 19 is a side perspective view of a top left end of the first portion of the cremation box of FIG. 15 in a partially assembled position, in accordance with an embodiment of the present invention.

Step 6:

FIG. 19 is a side perspective view of a top left end of the first portion of the cremation box of FIG. 15 in a partially assembled position, in accordance with an embodiment of the present invention. In FIG. 19, the other side panel, for example, the left side panel 120 is folded upwardly to be positioned in a substantially perpendicular relationship to the cremation box body portion 110. The top end panel 140 is already positioned in a substantially perpendicular relationship to the cremation box body portion 110 and the left side panel 120, and the top left inside side flap 142 is folded down against the outside of the left side panel 120 along crease 143 and the top left outside side flap 145 is folded toward and pushed through top left slot 123.

Figure 20:
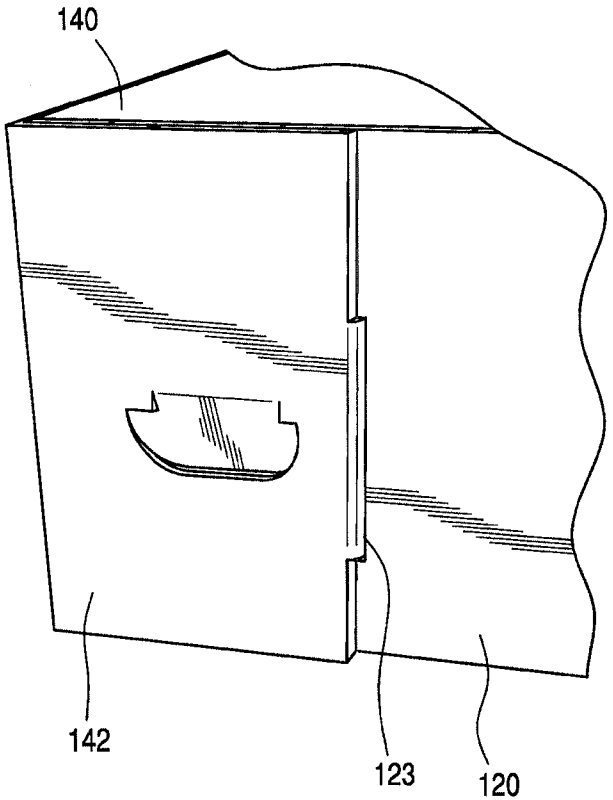
FIG. 20 is an outside view of the top left end of the first portion of the cremation box of FIG. 15 in a fully assembled position, in accordance with an embodiment of the present invention.

FIG. 20 is an outside view of the top left end of the first portion of the cremation box of FIG. 15 in a fully assembled position, in accordance with an embodiment of the present invention.

Figure 21:
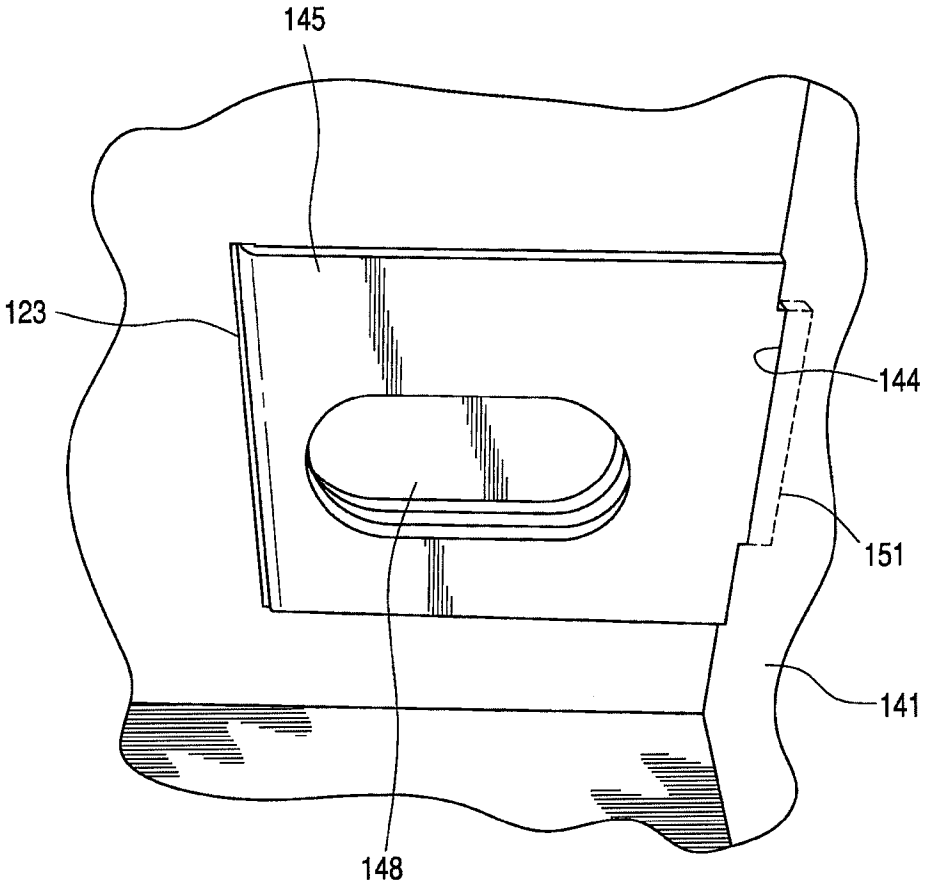
FIG. 21 is an inside view of the top left end of the first portion of the cremation box of FIG. 15 in a fully assembled position, in accordance with an embodiment of the present invention.

FIG. 21 is an inside view of the top left end of the first portion of the cremation box of FIG. 15 in a fully assembled position, in accordance with an embodiment of the present invention. In FIG. 21, the top left outside side flap 145 is fully pushed through top left slot 123 and folded back toward the top end panel 140 and tab 151 is inserted into slot 144 in top end panel 140 to lock the assembly into place and should now stand on their own and be joined into place without requiring any outside force or material. At this stage of the assembly, the left inside side flap hand hole 148 should not be pushed through the other hand holes, if the liner 700 will be used with the cremation box 100. Upon locking the left side panel into place, the cremation box 100 should stand on its own and, in some embodiments, should require no additional means in order to serve its ultimate purpose.

Figure 22:
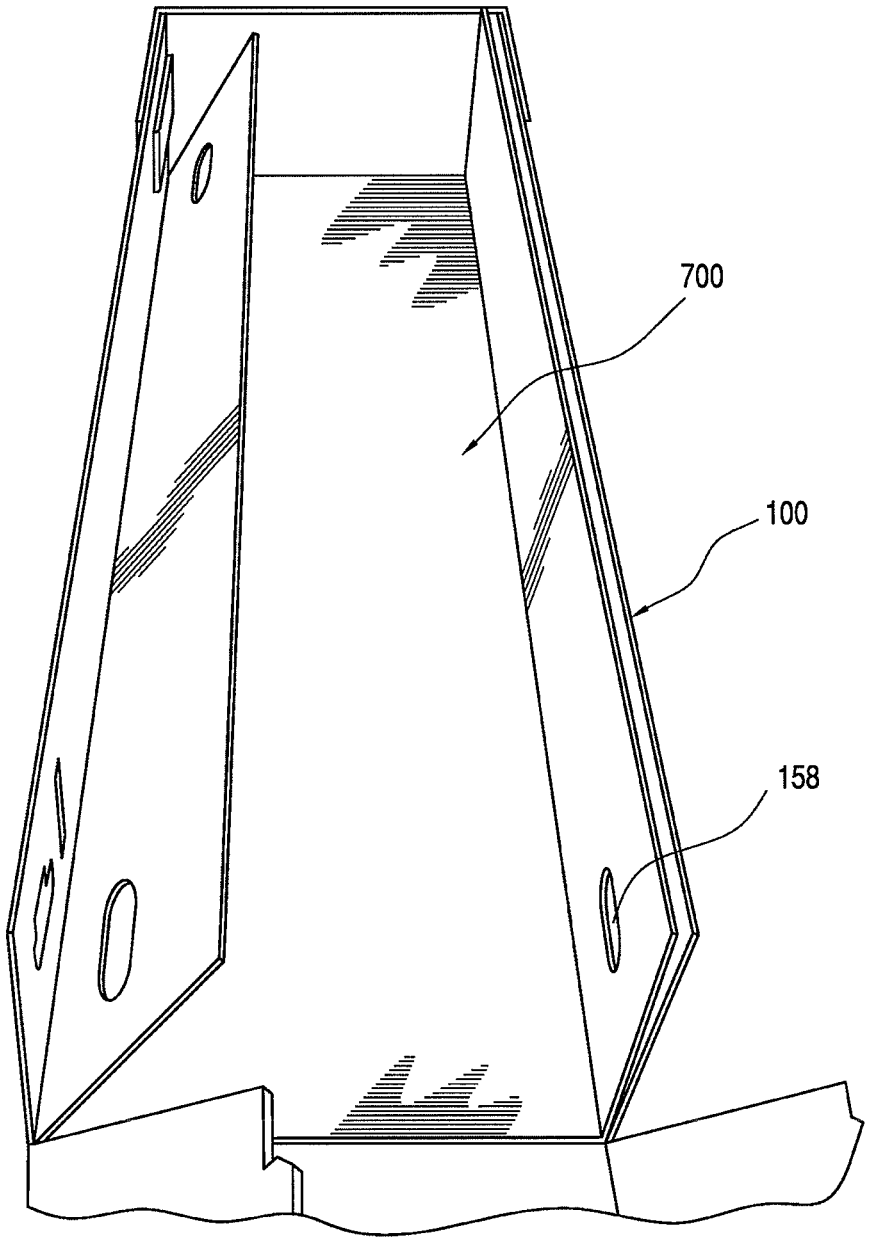
FIG. 22 is top perspective view of the partially assembled first portion of the cremation box with a liner being positioned inside, in accordance with an embodiment of the present invention.

Step 7:

If applicable, the liner 700 is placed inside the cremation box 100 and locked into place by pushing the left inside side flap hand hole 148 and the right inside side flap hand hole 158 through the hand holes and toward the inside of the cremation box 100. FIG. 22 is top perspective view of the partially assembled first portion of the cremation box 100 with the liner 700 being positioned inside the cremation box 100, in accordance with an embodiment of the present invention.

Figure 23:
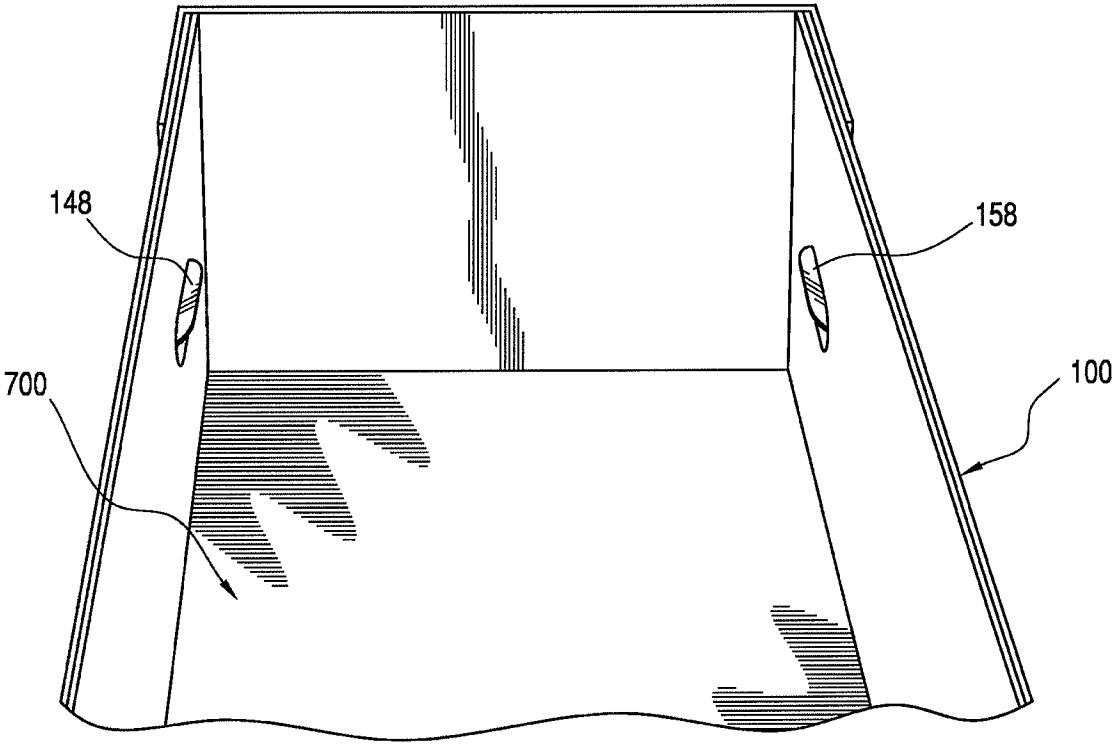
FIG. 23 is top perspective view of the top end of the partially assembled first portion of the cremation box of FIG. 22 with the liner positioned inside, in accordance with an embodiment of the present invention.

FIG. 23 is top perspective view of the top end of the partially assembled first portion of the cremation box of FIG. 22 with the liner positioned inside and locked inside the cremation box 100, in accordance with an embodiment of the present invention.

If no liner is required, the top end of box is locked into place by pushing the left inside side flap hand hole 148 and the right inside side flap hand hole 158 through the slots designated for hand holes. This provides an extra level of support for the cremation box.

Figure 24:
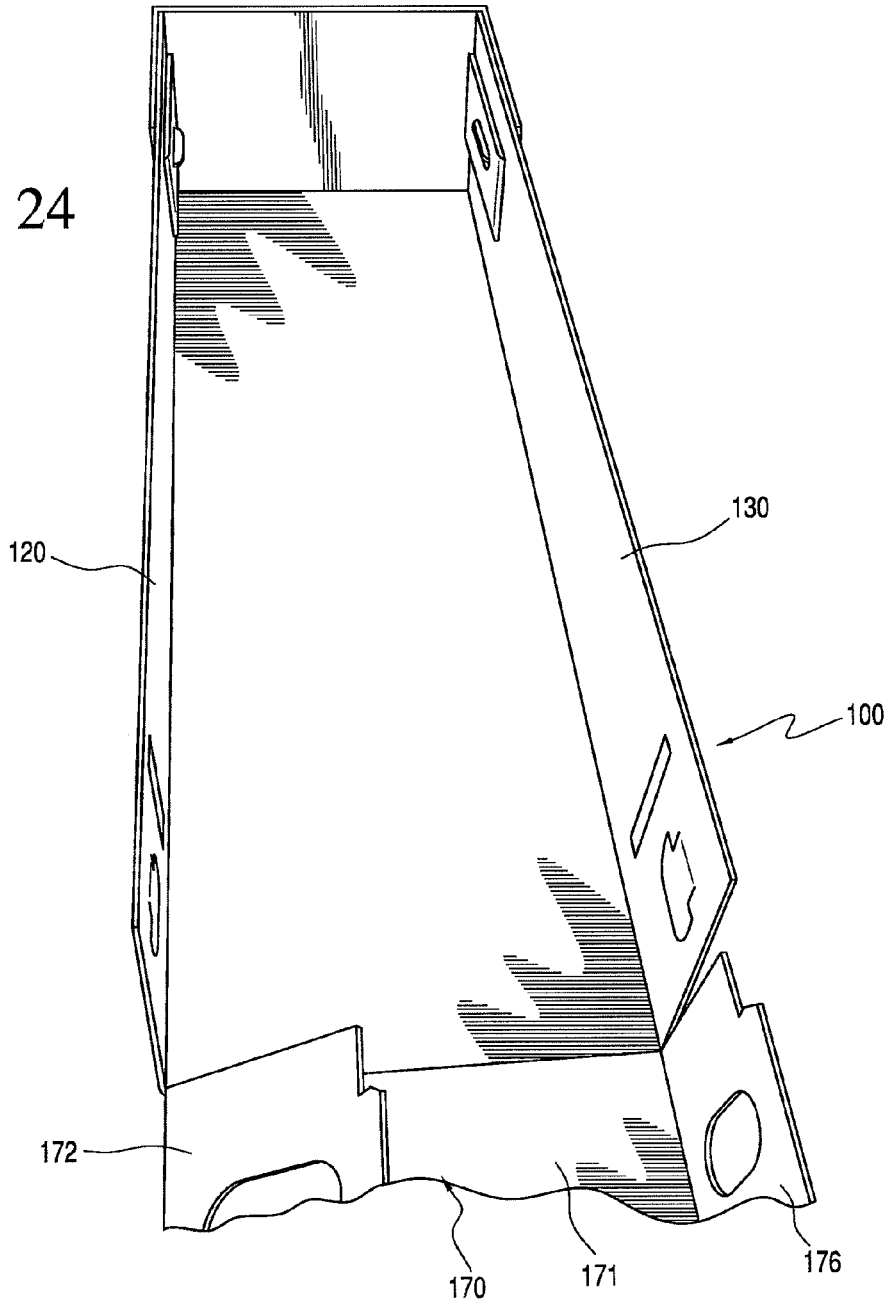
FIG. 24 is top perspective view of the partially assembled first portion of the cremation box without the liner positioned inside, in accordance with another embodiment of the present invention.

Step 8:

FIG. 24 is top perspective view of the partially assembled first portion of the cremation box without the liner positioned inside and ready for body placement, in accordance with another embodiment of the present invention.

Figure 25:
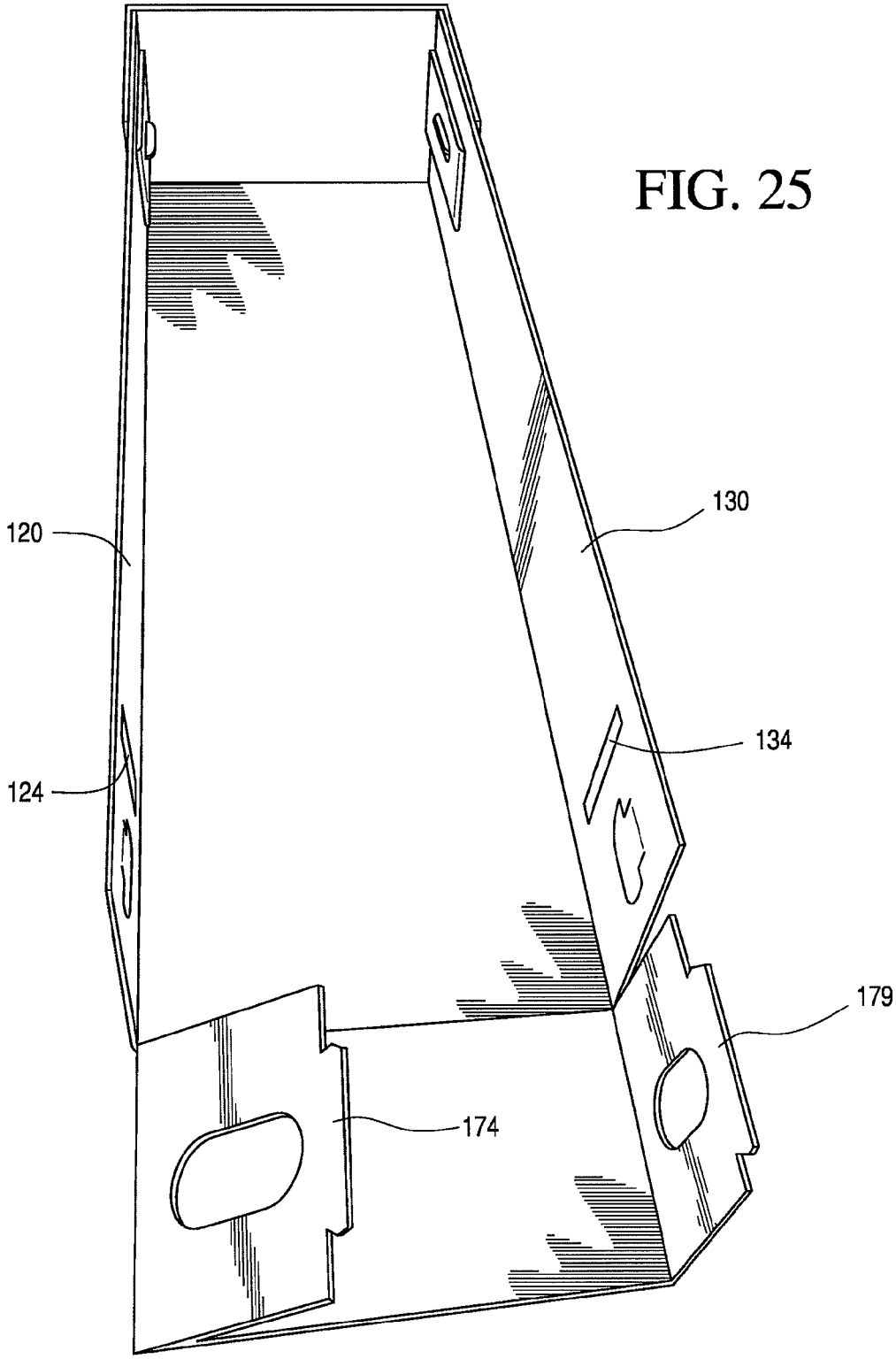
FIG. 25 is a top perspective view of the bottom end of the partially assembled first portion of the cremation box without the liner positioned inside, in accordance with another embodiment of the present invention.
Figure 27:
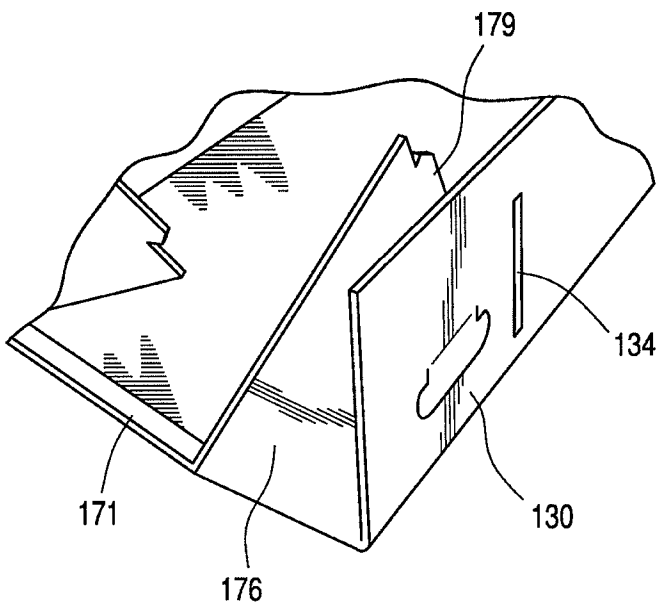
FIG. 27 is a top perspective view of the bottom end of the partially assembled first portion of the cremation box of FIG. 26 with the bottom end partially positioned inside the side walls, in accordance with another embodiment of the present invention.
Figure 26:
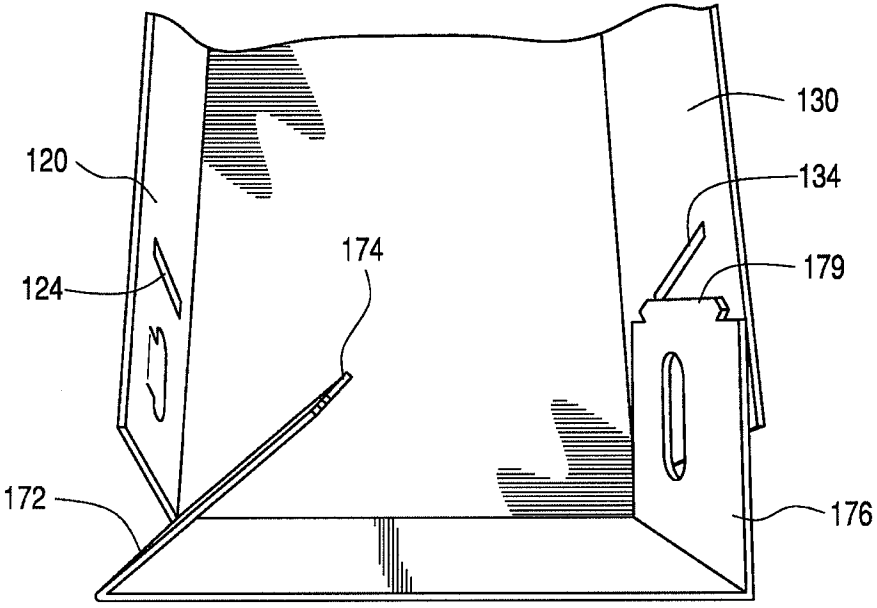
FIG. 26 is a top perspective view of the bottom end of the partially assembled first portion of the cremation box of FIG. 25 with the bottom end partially positioned inside the side walls, in accordance with another embodiment of the present invention.

Step 9:

In order to close the bottom of the box, for example, after the body of the deceased is placed in the unit, the bottom right and left flaps 172, 176 are folded back toward the bottom center panel 171 and the bottom end panel 170 is raised up toward the bottom edges of the side panels and the flaps are placed on the inside of cremation box 100 side panels 120, 130. FIG. 25 is a top perspective view of the bottom end of the partially assembled first portion of the cremation box without the liner positioned inside, in accordance with another embodiment of the present invention. The smaller left and right bottom tabs 174, 179 should align directly with the bottom left and bottom right slots, respectively, on the side panels. FIG. 26 is a top perspective view of the bottom end of the partially assembled first portion of the cremation box of FIG. 25 with the bottom end partially positioned inside the side walls, in accordance with another embodiment of the present invention. FIG. 27 is a top perspective view of the bottom end of the partially assembled first portion of the cremation box of FIG. 26 with the bottom end partially positioned inside the side walls, in accordance with another embodiment of the present invention.

Figure 28:
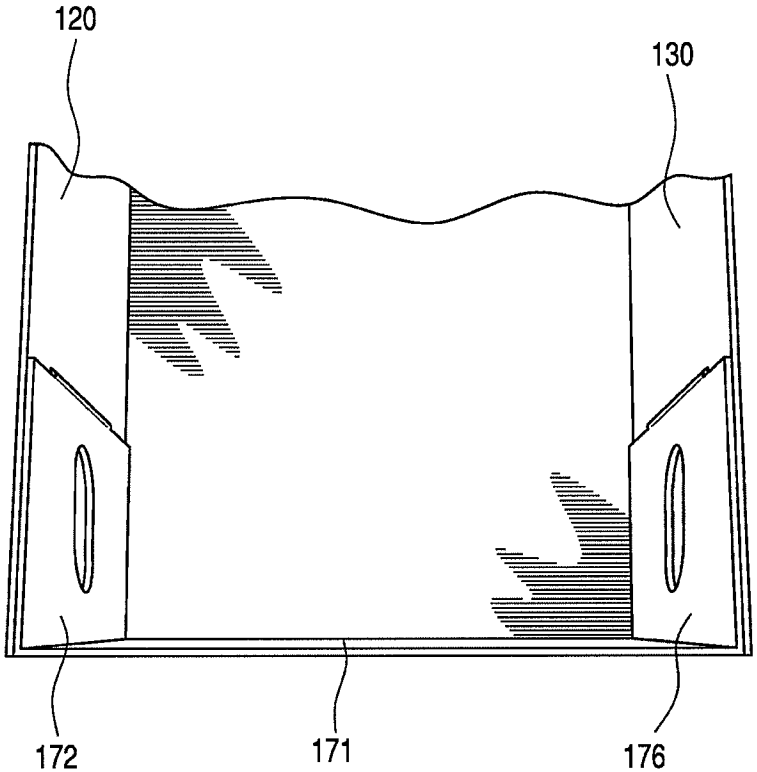
FIG. 28 is a top perspective view of the bottom end of the fully assembled first portion of the cremation box, in accordance with another embodiment of the present invention.

Step 10:

FIG. 28 is a top perspective view of the bottom end of the fully assembled first portion of the cremation box, in accordance with another embodiment of the present invention.

Figure 29:
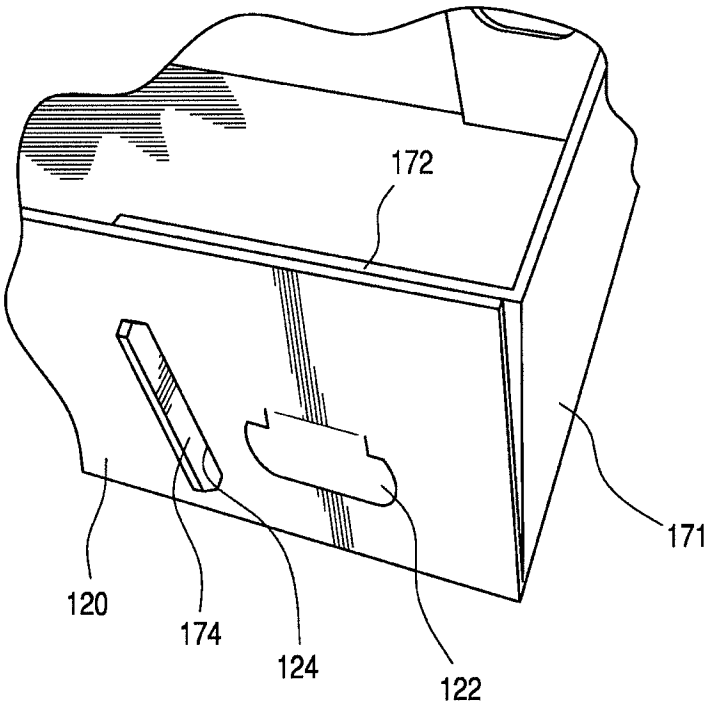
FIG. 29 is a top perspective view of the left bottom end of the fully assembled first portion of the cremation box, in accordance with another embodiment of the present invention.
Figure 30:
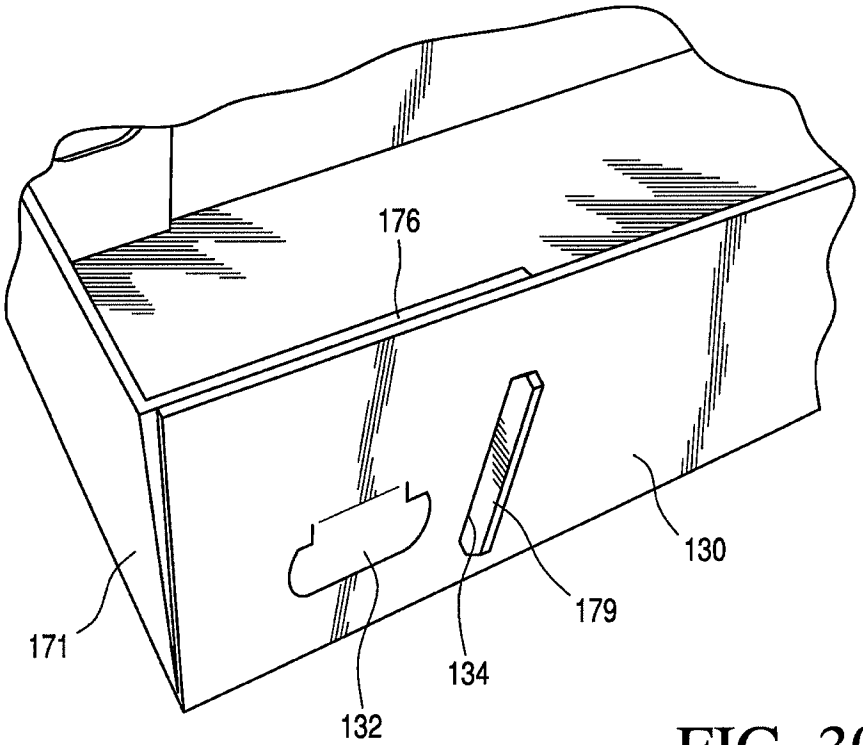
FIG. 30 is a top perspective view of the right bottom end of the fully assembled first portion of the cremation box, in accordance with another embodiment of the present invention.

FIG. 29 is a top perspective view of the left bottom end of the fully assembled first portion of the cremation box, in accordance with another embodiment of the present invention. FIG. 30 is a top perspective view of the right bottom end of the fully assembled first portion of the cremation box, in accordance with another embodiment of the present invention. To fasten the bottom panel into place, after extending the bottom panel up, slide the bottom flaps 174, 179 through the slots located on the side panels. Extend each flap completely through the associated side panel in order for the bottom panel to be flush with the side panels. Once again, the hand hole flaps 122, 132 are pushed into the inside of the cremation box 100 to secure the bottom panel to the sides 120, 130. The tabs 174, 179 may be folded back toward the bottom end of the creation box 100 to further secure them in place. As a result, the walls are locked into place with no need for additional materials.

The cremation box 100 assembly is now complete ready for the top 300 and final destination.

Figure 31:
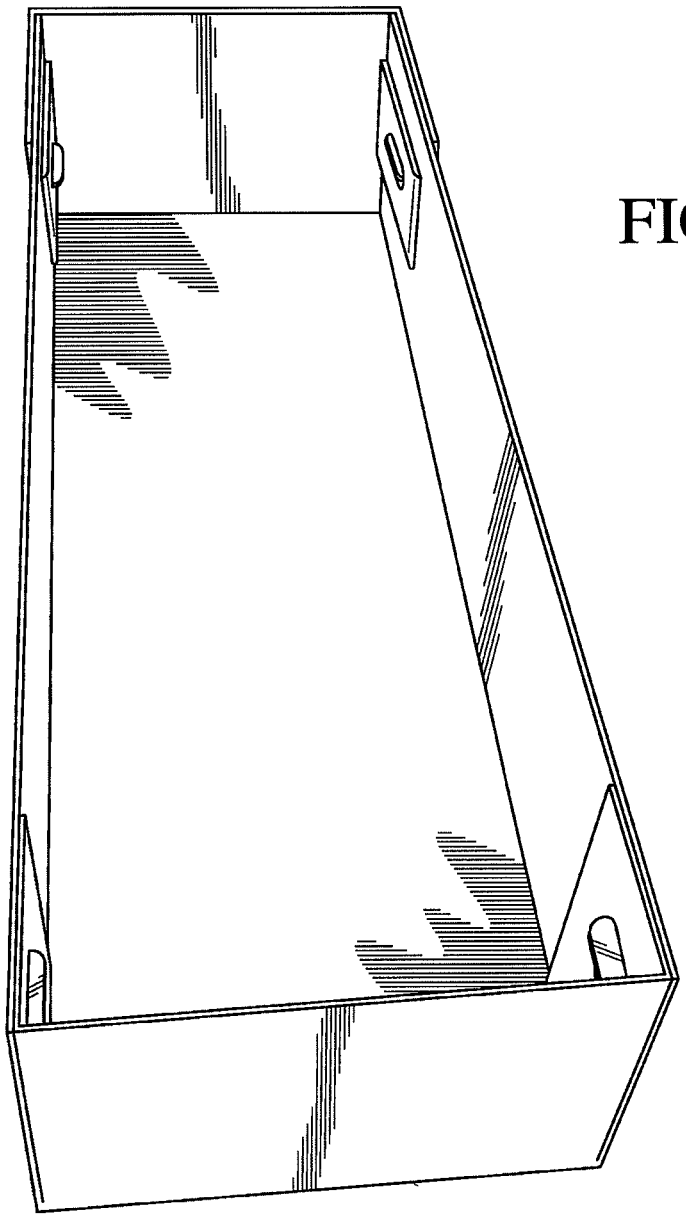
FIG. 31 is a top perspective view of the fully assembled first portion of the cremation box without a liner, in accordance with another embodiment of the present invention.
Figure 32:
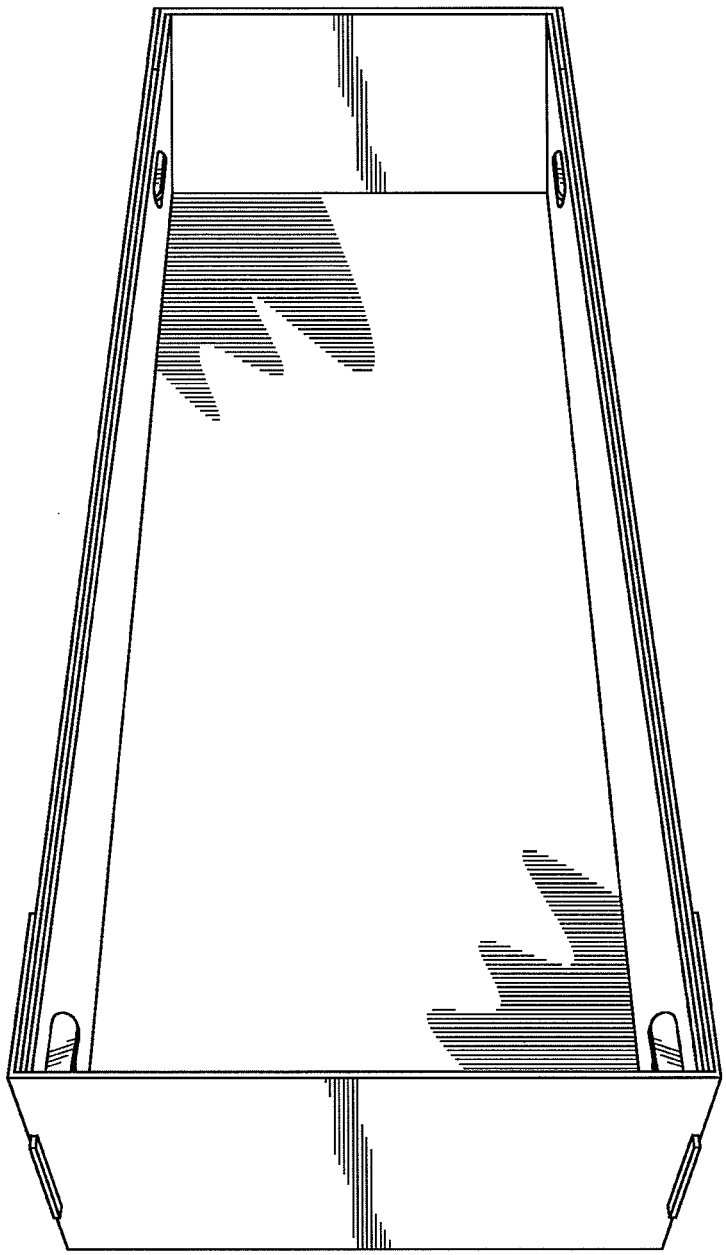
FIG. 32 is a top perspective view of the fully assembled first portion of the cremation box with a liner, in accordance with another embodiment of the present invention.
Figure 33:
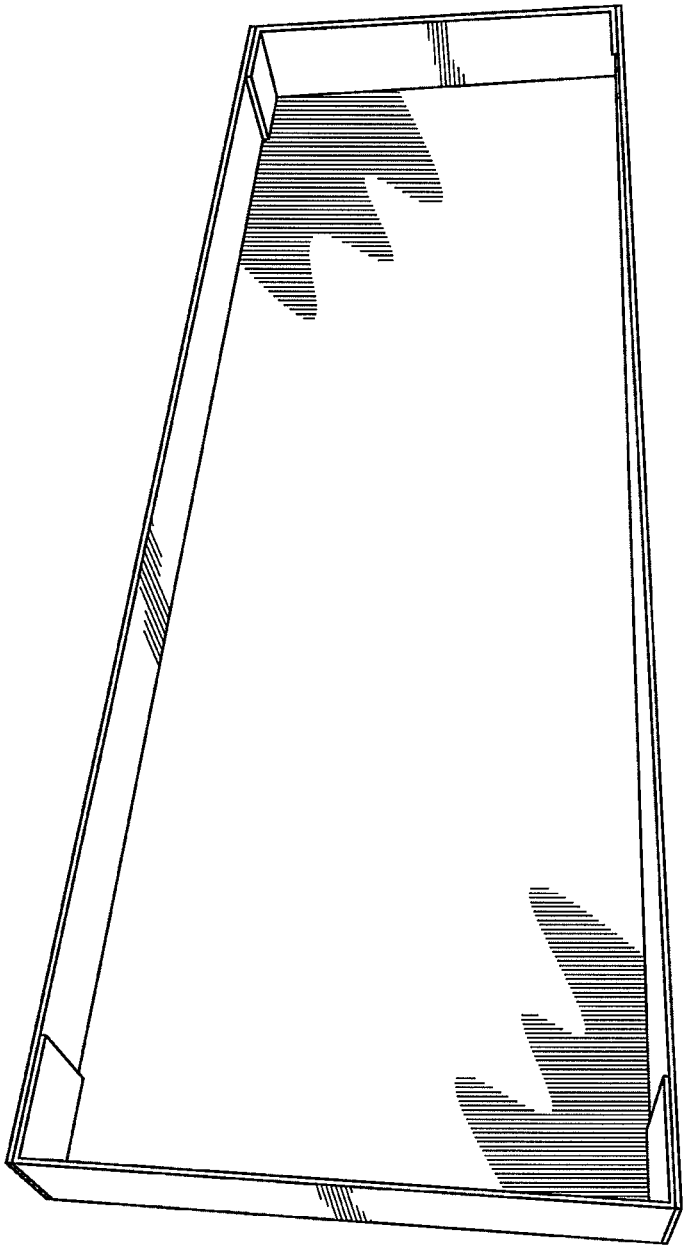
FIG. 33 is a top perspective view of one half of a container in which a cremation box is shipped, in accordance with an embodiment of the present invention.
Figure 34:
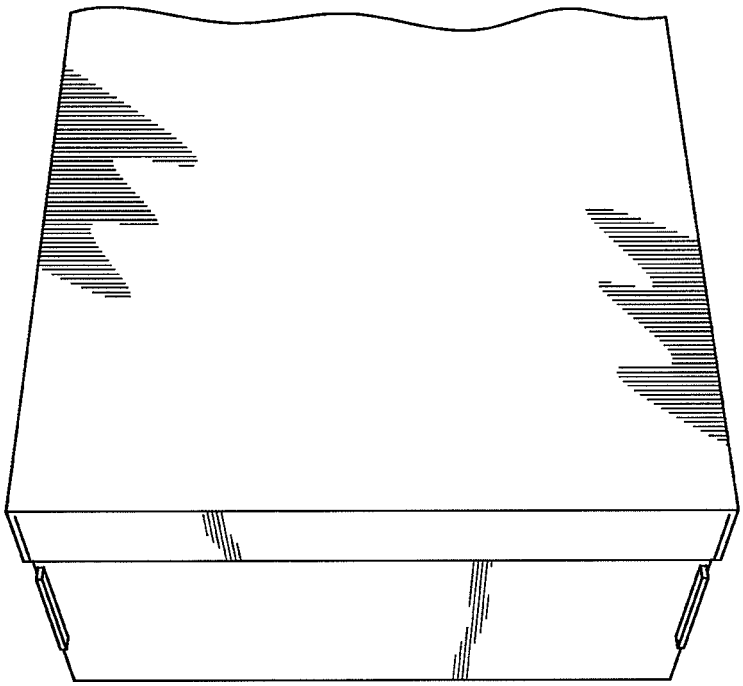
FIG. 34 is a top perspective view of the bottom end of the fully assembled cremation box, in accordance with another embodiment of the present invention.
Figure 35:
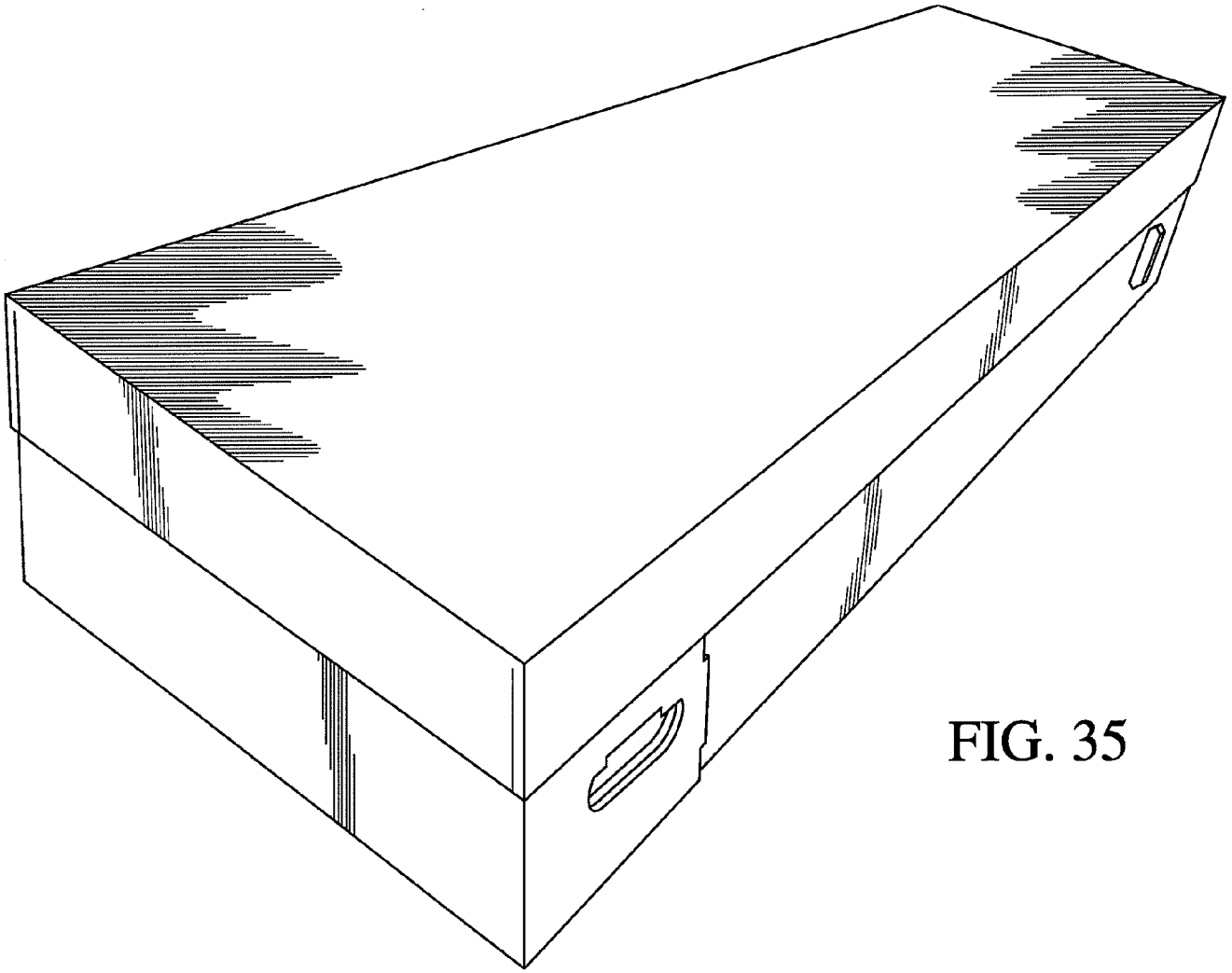
FIG. 35 is a top perspective view of the top end of the fully assembled cremation box, in accordance with another embodiment of the present invention.

Step 11:

FIG. 31 is a top perspective view of the fully assembled first portion of the cremation box without a liner, in accordance with another embodiment of the present invention. FIG. 32 is a top perspective view of the fully assembled first portion of the cremation box with a liner, in accordance with another embodiment of the present invention. FIG. 33 is a top perspective view of one half of a container in which a cremation box is shipped, in accordance with an embodiment of the present invention. FIG. 34 is a top perspective view of the bottom end of the fully assembled cremation box, in accordance with another embodiment of the present invention. Utilizing the top piece of the original shipping container, which was set aside as required by Step 1, place this piece on top of the newly constructed unit. The snug fit will ease any logistical questions and answer any needs for straps, tape or other adhesive materials. FIG. 35 is a top perspective view of the top end of the fully assembled cremation box, in accordance with another embodiment of the present invention.

The cremation box is now complete and ready for combustion.

While the invention has been described in conjunction with a number of embodiments, it is evident that many alternatives, modifications and variations would be or are apparent to those of ordinary skill in the applicable arts. Accordingly, Applicants intend to embrace all such alternatives, modifications, equivalents and variations that are within the spirit and scope of the appended claims.

The invention claimed is:

1. A corrugated fiberboard box assembly comprising:

a cremation box including a bottom section having a pair of opposite long edges and a pair of opposite short edges, a pair of opposing side panels running along and connected to the pair of opposite long edges, a pair of opposing end panels running along and connected to the pair of opposite short edges, the pair of opposing side panels including a left side panel and a right side panel, the left side panel including a top left hand hole formed therein adjacent a top end of the left side panel and a bottom left hand hole formed therein adjacent a bottom end of the left side panel with a bottom left side panel flap portion remaining connected to the bottom left side panel, the right side panel including a top right hand hole formed therein adjacent a top end of the right side panel and a bottom right hand hole formed therein adjacent a bottom end of the right side panel with a bottom right side panel flap portion remaining connected to the bottom right side panel, the pair of opposing end panels including a top end panel and a bottom end panel, the top end panel including a top end center section connected to a top left inside side flap on one side, the top left inside side flap in tum being connected to a top left outside flap on another side of the top left inside flap, a top left slot being formed in a left edge of the top end center section with one side adjacent the top left inside side flap, the top left outside flap having an open hand hole formed therein and a tab extending outwardly away from and along a portion of an outer left edge of the top left outside flap, a left inside side flap hand hole being formed in about a center of the top left inside side flap with a portion of the top left inside side flap remaining connected to the top left inside side flap, the top end center section further being connected to a top right inside side flap on one side, the top right inside side flap in tum being connected to a top right outside flap on another side of the top right inside flap, a top right slot being formed in a right edge of the top end center section with one side adjacent the top right inside side flap, the top right outside flap having an open hand hole formed therein and a tab extending outwardly away from and along a portion of an outer right edge of the top right outside flap, a right inside side flap hand hole being formed in about a center of the top right inside side flap with a portion of the top right inside side flap remaining connected to the top right inside side flap, the bottom end panel including a bottom end center section connected to a bottom left inside side flap on one side, the bottom left inside side flap in tum being connected to a bottom left outside flap on another side of the bottom left inside flap, a left inside side flap hand hole being formed in about a center of the bottom left inside side flap, and the bottom end center section further being connected to a bottom right inside side flap on one side, the bottom right inside side flap in tum being connected to a bottom right outside flap on another side of the bottom right inside side flap, a right inside side flap hand hole being formed in about a center of the bottom right inside side flap;

a top portion including a top section bounded by a pair of opposite long edges and a pair of opposite short edges, a pair of opposing side panels running along and connected to the pair of opposite long edges, a pair of opposing end panels running along, connected to and extending past opposite ends of the pair of opposite short edges; and a liner portion including a center section bounded by a pair of opposite long edges and a pair of opposite short edges connected to a pair of opposing side panels, and a pair of opposing side panels connected to the opposite side edges.

2. The corrugated fiberboard box assembly of claim 1 wherein the cremation box is made from 1-350 BC Kraft fiberboard.

3. The corrugated fiberboard box assembly of claim 1 wherein the top portion is made from 1-200 BC Kraft fiberboard.

4. The corrugated fiberboard box assembly of claim 1 wherein the liner portion is made from 1-275 BC Kraft fiberboard.

5. The corrugated fiberboard box assembly of claim 1 wherein the cremation box is folded into an open box by interlocking the opposing side panels with the opposing end panels.

6. The corrugated fiberboard box assembly of claim 5 wherein the liner portion is folded into a U-shape and inserted into the open box and interlocked with the open box by folding the bottom left side panel flap portion, the bottom right side panel flap portion, the top left inside side flap portion and the top right inside flap portion through the associated hand holds in the liner portion.

7. The corrugated fiberboard box assembly of claim 6 wherein the top portion is folded into an open top by interlocking the opposing top portion side panels with the opposing top portion end panels and place on the top of the open box.

8. The corrugated fiberboard box assembly of claim 5 wherein the bottom left side panel flap portion, the bottom right side panel flap portion, the top left inside side flap portion and the top right inside flap portion are folded through the associated hand holds in the open box.

9. The corrugated fiberboard box assembly of claim 8 wherein the top portion is folded into an open top by interlocking the opposing top portion side panels with the opposing top portion end panels and place on the top of the open box.

10. A corrugated fiberboard box kit comprising:

a top piece;

a bottom piece configured to fit with the top piece and form a shipping container;

a plurality of pairs of a cremation box and a liner, each cremation box including a bottom section bounded by a pair of opposite long edges and a pair of opposite short edges, a pair of opposing side panels running along and connected to the pair of opposite long edges, a pair of opposing end panels running along and connected to the pair of opposite short edges, the pair of opposing side panels including a left side panel and a right side panel, the left side panel including a top left hand hole formed therein adjacent a top end of the left side panel and a bottom left hand hole formed therein adjacent a bottom end of the left side panel, the right side panel including a top right hand hole formed therein adjacent a top end of the right side panel and a bottom right hand hole formed therein adjacent a bottom end of the right side panel, the pair of opposing end panels including a top end panel and a bottom end panel, the top end panel including a top end center section connected to a top left inside side flap on one side, the top left inside side flap in tum being connected to a top left outside flap on another side of the top left inside flap, a top left slot being formed in a left edge of the top end center section with one side adjacent the top left inside side flap, the top left outside flap having an open hand hole formed therein and a tab extending outwardly away from and along a portion of an outer left edge of the top left outside flap, a left inside side flap hand hole being formed in about a center of the top left inside side flap with a portion of the top left inside side flap remaining connected to the top left inside side flap, the top end center section further being connected to a top right inside side flap on one side, the top right inside side flap in tum being connected to a top right outside flap on another side of the top right inside flap, a top right slot being formed in a right edge of the top end center section with one side adjacent the top right inside side flap, the top right outside flap having an open hand hole formed therein and a tab extending outwardly away from and along a portion of an outer right edge of the top right outside flap, a right inside side flap hand hole being formed in about a center of the top right inside side flap with a portion of the top right inside side flap remaining connected to the top right inside side flap, the bottom end panel including a bottom end center section connected to a bottom left inside side flap on one side, the bottom left inside side flap in tum being connected to a bottom left outside flap on another side of the bottom left inside flap, a left inside side flap hand hole being formed in about a center of the bottom left inside side flap, and the bottom end center section further being connected to a bottom right inside side flap on one side, the bottom right inside side flap in tum being connected to a bottom right outside flap on another side of the bottom right inside side flap, a right inside side flap hand hole being formed in about a center of the bottom right inside side flap, each liner portion including a center section bounded by a pair of opposite long edges and a pair of opposite short edges connected to a pair of opposing side panels, and a pair of opposing side panels connected to the opposite side edges; and a top portion including a top section bounded by a pair of opposite long edges and a pair of opposite short edges, a pair of opposing side panels running along and connected to the pair of opposite long edges, a pair of opposing end panels running along, connected to and extending past opposite ends of the pair of opposite shorts edges by another two of the plurality of creases.

11. The corrugated fiberboard box kit of claim 10 wherein the cremation box is made from 1-350 BC Kraft fiberboard.

12. The corrugated fiberboard box assembly of claim 10 wherein the top portion is made from 1-200 BC Kraft fiberboard.

13. The corrugated fiberboard box assembly of claim 10 wherein the liner portion is made from 1-275 BC Kraft fiberboard.

* * * * *